US007730552B2

(12) United States Patent
Ota et al.

(10) Patent No.: US 7,730,552 B2
(45) Date of Patent: Jun. 8, 2010

(54) PANTS GARMENT

(75) Inventors: Yuji Ota, Kyoto (JP); Naomi Morii, Kyoto (JP); Takako Fujii, Kyoto (JP); Makoto Oyama, Kyoto (JP)

(73) Assignee: Wacoal Corp., Kyoto-shi, Kyoto (JP)

( * ) Notice: Subject to any disclaimer, the term of this patent is extended or adjusted under 35 U.S.C. 154(b) by 677 days.

(21) Appl. No.: 10/823,994

(22) Filed: Apr. 13, 2004

(65) Prior Publication Data

US 2004/0255358 A1 Dec. 23, 2004

Related U.S. Application Data

(60) Provisional application No. 60/463,994, filed on Apr. 17, 2003, provisional application No. 60/516,040, filed on Oct. 31, 2003.

(30) Foreign Application Priority Data

Apr. 15, 2003 (JP) ..... 2003-110882

(51) Int. Cl.
*A41D 1/08* (2006.01)
*A41D 13/00* (2006.01)

(52) U.S. Cl. ..... 2/69; 2/227

(58) Field of Classification Search ..... 2/69, 2/227, 228, 2.15, 409, 401, 238, 242; D2/742, D2/731, 712
See application file for complete search history.

(56) References Cited

U.S. PATENT DOCUMENTS 3,338,776 A * 8/1967 Blair ..... 428/88
3,411,500 A * 11/1968 Gatts ..... 600/20
3,934,583 A 1/1976 Hollingshead et al.
4,492,227 A 1/1985 Senn et al.
4,644,946 A * 2/1987 Cremona-Bonato ..... 602/61
4,862,523 A * 9/1989 Lipov ..... 2/409

(Continued)

FOREIGN PATENT DOCUMENTS

CN 1232369 10/1999

(Continued)

OTHER PUBLICATIONS

Patent Abstracts of Japan for JP-10-110306 published on Apr. 28, 1998.

(Continued)

*Primary Examiner*—Alissa L Hoey
(74) *Attorney, Agent, or Firm*—Leydig, Voit & Mayer, Ltd.

(57) ABSTRACT

A pants garment has a pair of thigh leg members for covering the thigh area of a wearer. A front thigh elastic band member is provided substantially at a front side of each of the thigh leg members and extends obliquely from an upper front portion to a lower front portion of each thigh leg member. A back thigh elastic band member is provided substantially at a back side of each of the thigh leg members and extends obliquely from an upper back portion to a lower back portion of each thigh leg member. The garment also has a front and back crus elastic band members extending obliquely on crus leg members, which cover the crus areas of the wearer.

15 Claims, 21 Drawing Sheets

U.S. PATENT DOCUMENTS

| | | | | | |
|---|---|---|---|---|---|
| 4,986,263 | A | | 1/1991 | Dickerson et al. | |
| 5,201,074 | A | * | 4/1993 | Dicker | 2/70 |
| 5,267,928 | A | * | 12/1993 | Barile et al. | 482/124 |
| 5,282,277 | A | * | 2/1994 | Onozawa | 2/69 |
| 5,367,708 | A | * | 11/1994 | Fujimoto | 2/22 |
| 5,403,271 | A | | 4/1995 | Saunders et al. | |
| 5,465,428 | A | * | 11/1995 | Earl | 2/238 |
| 5,556,374 | A | | 9/1996 | Grace et al. | |
| D385,385 | S | * | 10/1997 | Dicker | D2/731 |
| 5,727,254 | A | * | 3/1998 | Dicker | 2/69 |
| 5,735,807 | A | | 4/1998 | Cropper | |
| 5,737,772 | A | * | 4/1998 | Dicker et al. | 2/69 |
| 5,737,773 | A | * | 4/1998 | Dicker et al. | 2/69 |
| 5,745,917 | A | * | 5/1998 | Dicker et al. | 2/69 |
| 5,819,322 | A | * | 10/1998 | Dicker et al. | 2/456 |
| D404,538 | S | * | 1/1999 | Fujii et al. | D2/742 |
| 5,867,827 | A | * | 2/1999 | Wilkinson | 2/69 |
| 5,925,010 | A | | 7/1999 | Caprio, Jr. | |
| D413,008 | S | * | 8/1999 | Fujii et al. | D2/742 |
| 5,937,441 | A | * | 8/1999 | Raines | 2/69 |
| 5,968,002 | A | * | 10/1999 | Morrisseau | 602/62 |
| 5,978,966 | A | * | 11/1999 | Dicker et al. | 2/69 |
| 6,047,405 | A | * | 4/2000 | Wilkinson | 2/69 |
| 6,047,406 | A | * | 4/2000 | Dicker et al. | 2/69 |
| D427,750 | S | * | 7/2000 | Fujii et al. | D2/738 |
| 6,142,965 | A | | 11/2000 | Mathewson | |
| 6,161,222 | A | | 12/2000 | Strickland et al. | |
| 6,186,970 | B1 | * | 2/2001 | Fujii et al. | 602/75 |
| 6,189,155 | B1 | * | 2/2001 | Boulanger | 2/409 |
| 6,231,488 | B1 | * | 5/2001 | Dicker et al. | 482/124 |
| D460,602 | S | * | 7/2002 | Tanaka | D2/742 |
| 6,430,752 | B1 | * | 8/2002 | Bay | 2/228 |
| D465,078 | S | * | 11/2002 | Tanaka | D2/742 |
| D465,315 | S | * | 11/2002 | Tanaka | D2/742 |
| D465,900 | S | * | 11/2002 | Tanaka | D2/742 |
| D466,674 | S | * | 12/2002 | Tanaka | D2/742 |
| 6,684,410 | B2 | * | 2/2004 | Robinett et al. | 2/228 |
| D505,769 | S | * | 6/2005 | Ota et al. | D2/731 |
| D507,857 | S | * | 8/2005 | Ota et al. | D2/742 |
| D508,304 | S | * | 8/2005 | Ota et al. | D2/742 |
| D512,812 | S | * | 12/2005 | Ota et al. | 2/731 |
| D513,830 | S | * | 1/2006 | Ota et al. | D2/731 |
| D517,279 | S | * | 3/2006 | Fujii | D2/731 |
| D520,715 | S | * | 5/2006 | Ota et al. | D2/731 |
| 7,074,204 | B2 | * | 7/2006 | Fujii et al. | 602/75 |
| 7,229,390 | B2 | * | 6/2007 | Fujii et al. | 482/124 |
| 7,516,498 | B2 | * | 4/2009 | Torry | 2/69 |
| 2001/0014981 | A1 | * | 8/2001 | Fairhurst et al. | 2/69 |
| 2003/0028952 | A1 | | 2/2003 | Fujii et al. | |
| 2004/0107479 | A1 | * | 6/2004 | Dicker et al. | 2/227 |
| 2004/0111781 | A1 | * | 6/2004 | Miyake et al. | 2/69 |
| 2005/0086721 | A1 | * | 4/2005 | Lambertz | 2/69 |
| 2005/0193461 | A1 | * | 9/2005 | Caillibotte et al. | 2/69 |
| 2005/0210559 | A1 | * | 9/2005 | Gabriele | 2/69 |
| 2005/0241044 | A1 | * | 11/2005 | Zorica | 2/69 |
| 2006/0009726 | A1 | * | 1/2006 | Clement | 602/61 |
| 2006/0074365 | A1 | * | 4/2006 | Brown | 602/24 |
| 2007/0067892 | A1 | * | 3/2007 | Oyama et al. | 2/227 |
| 2007/0214541 | A1 | * | 9/2007 | Kawasaki et al. | 2/69 |
| 2008/0083055 | A1 | * | 4/2008 | Onda | 2/455 |

FOREIGN PATENT DOCUMENTS

| | | | |
|---|---|---|---|
| EP | 0 835 645 | A1 | 4/1998 |
| EP | 1 110 464 | A2 | 6/2001 |
| JP | 09-241906 | A | 9/1997 |
| JP | 10-110306 | | 4/1998 |
| JP | 10-280209 | A | 10/1998 |
| JP | 11-012814 | A | 1/1999 |
| JP | 11-061516 | | 3/1999 |
| JP | 2000-328305 | | 11/2000 |
| JP | 2001-192903 | A | 7/2001 |
| JP | 2002-212810 | A | 7/2002 |
| JP | 2002-212814 | A | 7/2002 |
| JP | 2002220708 | A | 8/2002 |

OTHER PUBLICATIONS

Patent Abstracts of Japan for JP-11-061516 published on Mar. 5, 1999.

Patent Abstracts of Japan for JP-2000-328305 published on Nov. 28, 2000.

International Search Report for PCT/JP2004/005325 mailed Aug. 10, 2004.

* cited by examiner

PANTS GARMENT

INCORPORATION BY REFERENCE

The present application claims priority under 35 U.S.C. §119 to Japanese Patent Application No. 2003-110882 filed on Apr. 15, 2003 and U.S. Provisional Application Ser. Nos. 60/463,994 filed on Apr. 17, 2003 and 60/516,040 filed on Oct. 31, 2003. The contents of the applications are incorporated herein by reference in their entireties.

BACKGROUND OF THE INVENTION

1. Field of the Invention

The present invention relates to a pants garment and, more particularly, to a sports pants garment.

2. Related Background Art

Some conventional sports pants garment has a support portion with a strong tightening force at a predetermined portion of the garment in order to support the motion of the leg muscles. For example, Japanese Patent publication Laid Open No. 10 110306 (Reference 1) discloses a pants garment which supports the motion of the muscles by clamping the thigh, knee, and calf with support portions from the left and right of the wearer. When this pants garment is worn, the support portions suppress the motion of the leg in the left to right direction, so the motion of the leg in the back and forth direction becomes stable. This garment also has the effect of supporting the bending and stretching motion of the hip joint and knee joint.

SUMMARY OF THE INVENTION

However, in addition to bending and stretching motions, the motions of the lower half of the body include, for example, inner and outer pivoting motions (adduction and abduction), inner and outer rotating motions (medial and lateral rotations). In the case of the pants garment disclosed in Reference 1, it is difficult to support these other motions, even if bending and stretching motions can be supported.

It is, therefore, an object of the present invention to provide a pants garment which supports the motion of the leg with a good balance.

In order to achieve the object, one implementation of the present invention includes (A) left and right thigh leg members for covering the left and right thigh areas of a wearer, each thigh leg member independently including a first thigh stretchable portion and a second thigh stretchable portion, wherein the second thigh stretchable portions have a greater tightening force for applying greater pressure than the first thigh stretchable portions; wherein the second thigh stretchable portions independently include:

(a) a front thigh elastic band member provided substantially at a front side of each of the thigh leg members, the front thigh elastic band member extending obliquely from an upper front portion to a lower front portion of each thigh leg member, (b) a back thigh elastic band member provided substantially at a back side of each of the thigh leg members, the back thigh elastic band member extending obliquely from an upper back portion to a lower back portion of each thigh leg member, and (c) optionally (i) an intermediate elastic band member extending obliquely from a middle portion of the front thigh elastic band member to an inner lower portion of the thigh leg member, (ii) an intermediate elastic band member extending obliquely from a middle portion of the front thigh elastic band member to an inner upper portion of the thigh leg member, (iii) an intermediate elastic band member extending obliquely from a middle portion of the back thigh elastic band member to an inner lower portion of the thigh leg member, (iv) an intermediate elastic band member extending obliquely from a middle portion of the back thigh elastic band member to an outer upper portion of the thigh leg member, (v) an intermediate elastic band member extending obliquely from a middle portion of the back thigh elastic band member to an outer lower portion of the thigh leg member, (vi) an intermediate elastic band member extending obliquely from a middle portion of the back thigh elastic band member to an inner upper portion of the thigh leg member, or (vii) any combination of any of (c)(i), (c)(ii), (c)(iii), (c)(iv); (c)(v), and (c)(vi);

(d) optionally a second back thigh elastic band member extending from an outer portion to an inner portion of the thigh leg member, such that the first and second back thigh elastic bands on the thigh member cross each other; and (e) optionally, an above-the-knee elastic band member provided at a portion of the thigh leg member corresponding to an area that spans from inside the knee to above the knee to outside of the knee; and (B) optionally, left and right crus leg members respectively attached to the left and right thigh leg members, for covering the left and right crus areas of a wearer, each crus leg member independently comprising a first crus stretchable portion and a second crus stretchable portion, wherein the second crus stretchable portions have a greater tightening force for greater applying pressure than the second crus stretchable portions;

wherein the second crus stretchable portions independently include:

(a) a front crus elastic band member provided substantially at a front of each crus leg member, the front crus elastic band member extending obliquely from an upper front portion to a lower front portion of the crus leg member;

(b) a back crus elastic band member provided substantially at a back side of the crus leg member, the back crus elastic band member extending obliquely from an upper back portion to a lower back portion of the crus leg member; or (c) optionally, a below-the-knee elastic band member provided at a portion of the thigh leg member corresponding to an area that spans from inside the knee to below the knee to outside the knee; or (d) any combination of any of (B)(a), (B)(b), and (B)(c);

(C) optionally, left and right pelvic members attached to the thigh members for covering the right and left pelvic areas of a wearer;

(D) optionally, an abdomen member attached to the pelvic members for covering the abdominal area of a wearer; and (E) optionally, a waist member attached to (i) the thigh leg members, (ii) the pelvic members, (iii) the abdominal member, or (iv) any combination of any of (E)(i), (E)(ii), and (E)(iii), for circumscribing the waist of the wearer.

According to the present invention, as the wearer's thigh is clamped by the front thigh elastic band member and back thigh elastic band member which have a tightening force, muscles in the front and rear sides of the thigh can be supported with a good balance, so that the legs can pivot inwardly and outwardly and rotate inwardly and outwardly easily.

In another implementation of the present invention, the front thigh elastic band member and the back thigh elastic band member preferably can incline respectively in opposite directions with respect to a vertical direction when seen from either a front side or a rear side. Furthermore, the front thigh elastic band member and back thigh elastic band member in the pants garment preferably can incline respectively in the same direction with respect to a vertical direction when seen from either the front side or rear side; in this case, it is desirable that the front thigh elastic band member and the back thigh elastic band member be continuous at least either at the inside of the thigh or the outside of the thigh. It is desirable that these elastic band members be continuous at both the inside of the thigh and the outside of the thigh. Here, "inside" refers to either the upper portion or lower portion of the inside of the thigh, "outside" refers to either the upper portion or lower portion of the outside of the thigh, and "continuous on both sides" refers to a continuation on the upper portion of the inside of the thigh and lower portion of the outside of the thigh, or on the lower portion of the inside of the thigh and the upper portion of the outside of the thigh. Furthermore, part of the elastic band member is preferably formed at a portion corresponding to the greater trochanter of a wearer.

In another embodiment of the present invention, it is desirable that the garment further has an intermediate elastic band member which extends obliquely from an intermediate point on at least either the front thigh elastic band member or the back thigh elastic band member to the lower inside of the thigh or lower outside of the thigh leg member. As a result, tension can be applied to at least either the front thigh elastic band member or the back thigh elastic band member, so that the supporting effect provided by the front thigh elastic band member and the back thigh elastic band member can be improved. It is further desirable that one part of the intermediate elastic band member is formed in a portion corresponding to the inside of the knee or the outside of the knee of the wearer, or that the intermediate elastic band member connects the front thigh elastic band member or the back thigh elastic band member with another elastic band portion that is formed in a portion corresponding to the inside of the knee or the outside of the knee. As a result, the knee of the wearer can be further supported. It is further desirable that the intermediate elastic band member in this case be formed from the vicinity of the center in the longitudinal direction of at least either the front thigh elastic band member or the back thigh elastic band member at the thigh. As a result, mutual tension can be applied more easily to the respective elastic band members.

In another embodiment of the present invention, it is desirable that the elastic band member further has an intermediate elastic band member which is formed obliquely from an intermediate point on at least either the front thigh elastic band member or back thigh elastic band member to the upper inside of the thigh or the upper outside of the thigh. As a result, tension can be applied to at least either the front thigh elastic band member or the back thigh elastic band member, so that the supporting effect provided by the front thigh elastic band member or the back thigh elastic band member can be improved. Furthermore, it is desirable that an intermediate elastic band member in this case be formed from the vicinity of the center in the longitudinal direction of at least either the front thigh elastic band member or back thigh elastic band member at the thigh. As a result, mutual tension can be applied more easily to the respective elastic band members.

According to another implementation of the present invention, the pants garment for covering at least part of a lower half of a body includes at least a pair of crus leg members for covering the crus area of a wearer; a front crus elastic band member provided substantially at a front of each of the crus leg members, the front crus elastic band member extending obliquely from an upper front portion to a lower front portion of each crus leg member; and a back crus elastic band member provided substantially at a back side of the crus leg member, the back crus elastic band member extending obliquely from an upper back portion to a lower back portion of each crus leg member.

According to the present invention, as the wearer's crus is clamped by the front crus elastic band member and the back crus elastic band member which have a tightening force, muscles in the front and rear sides of the crus can be supported with a good balance, so that the leg can pivot inwardly and outwardly and rotate inwardly and outwardly easily.

In the pants garment according the present invention, the front crus elastic band member and the back crus elastic band member preferably incline respectively in opposite directions with respect to a vertical direction when seen from either the front side or rear side. Furthermore, the front crus elastic band member and the back crus elastic band member in the pants garment of the present invention preferably incline respectively in a same direction with respect to the vertical direction when seen from either the front side or the rear side. It is desirable that the front crus elastic band member and back crus elastic band member are continuous at least at either the inside of the crus or the outside of the crus. Furthermore, it is desirable that these members are continuous at both the inside of the crus and the outside of the crus. As a result, mutual tension can be applied more easily to the respective members.

In according to another implementation of the present invention, part of the elastic band member is preferably formed at a portion corresponding to at least either an inside or an outside of the knee of a wearer. Then, at least either the inside or the outside of the knee is supported by part of the elastic band member, so the motion of the knee in the left to right direction is suppressed, and the motion of the leg in the back and forth direction is stabilized. As a result, the knee joint can bend and stretch easily. Here, the ranges indicated by "upper side of the knee", "lower side of the knee", "inside of the knee" and "outside of the knee" refer to positions within the knee joint, or positions located within a few centimeters of the outer circumference of the kneecap, and refer to positions that are close enough for direct stabilization of the knee joint by the elastic band member. Accordingly, it is sufficient if at least one part of the elastic band member is formed to correspond to such a position.

In another implementation of the present invention, the garment includes at least a pair of thigh leg members for covering the thigh area of a wearer; at least a pair of crus leg members for covering the crus area of a wearer, the crus leg members attached respectively to the thigh leg members at approximately the knee portion of the wearer; and a below-the-knee elastic band member provided at a portion of the crus leg member corresponding to an area that spans from inside the knee to below the knee to outside the knee of the wearer. The below-the-knee elastic band member can form a V-shape. Then, the inside, outside, and the lower side of the wearer's knee are firmly supported by the below-the-knee elastic band member having a tightening force. Hence, the knee can be stabilized, and any unwanted motion of the knee can be reduced. Furthermore, since the elastic band member does not contact the area above the knee or the area below the knee, the freedom of movement of the knee can be ensured.

It another implementation of the present invention, the garment has an above-the-knee elastic band member provided at a portion of the thigh leg member corresponding to an area that spans from inside the knee to above the knee to outside the knee. The above-the-knee elastic band member can form an upside down V-shape. As a result, the stability of the knee is improved.

In another implementation of the present invention, the garment further has a waist member attached to the thigh leg members for covering the waist portion of the wearer, pelvic region elastic band members which are disposed in the waist member corresponding to the left and right side portions of the pelvic region and an abdomen elastic band member which is disposed in the waist member corresponding to the abdomen. The abdomen elastic band member is connected to the pelvic region elastic band members that are located on the left and right sides. As a result, the pelvic region elastic band members that contact the left and right side portions of the pelvic region can be pulled toward the center of the body so that the hip joints and pelvis can be stabilized.

In another implementation, it is desirable that the front thigh elastic band member in the pants garment is formed from the lower part of inside of the thigh to the greater trochanter via the upper part of the front surface of the thigh, and is formed so that this portion is curved in an indented shape toward the upper part of the thigh. As a result, muscular contractions of the front surface of the thigh can be supported.

In still another implementation of the present invention, it is desirable that the garment has a hem part formed in a portion corresponding to the area above the knee, and that at least either the lower end of the front thigh elastic band member or the lower end of the back thigh elastic band member is located at the hem part. Furthermore, it is desirable that the upper part of the front thigh elastic band member and the upper part of the back thigh elastic band member are connected in a portion corresponding to the side part of the pelvic region, and that the lower part of the front thigh elastic band member and the lower part of the back thigh elastic band member are connected in a portion corresponding to the lower part of the inside of the thigh. As a result of the formation of such connections, tension is mutually applied to the front thigh elastic band member and back thigh elastic band member, so that the supporting effect of the thigh muscles is increased, and the hip joints can be supported.

DESCRIPTION OF THE PREFERRED EMBODIMENTS

Figure 1:
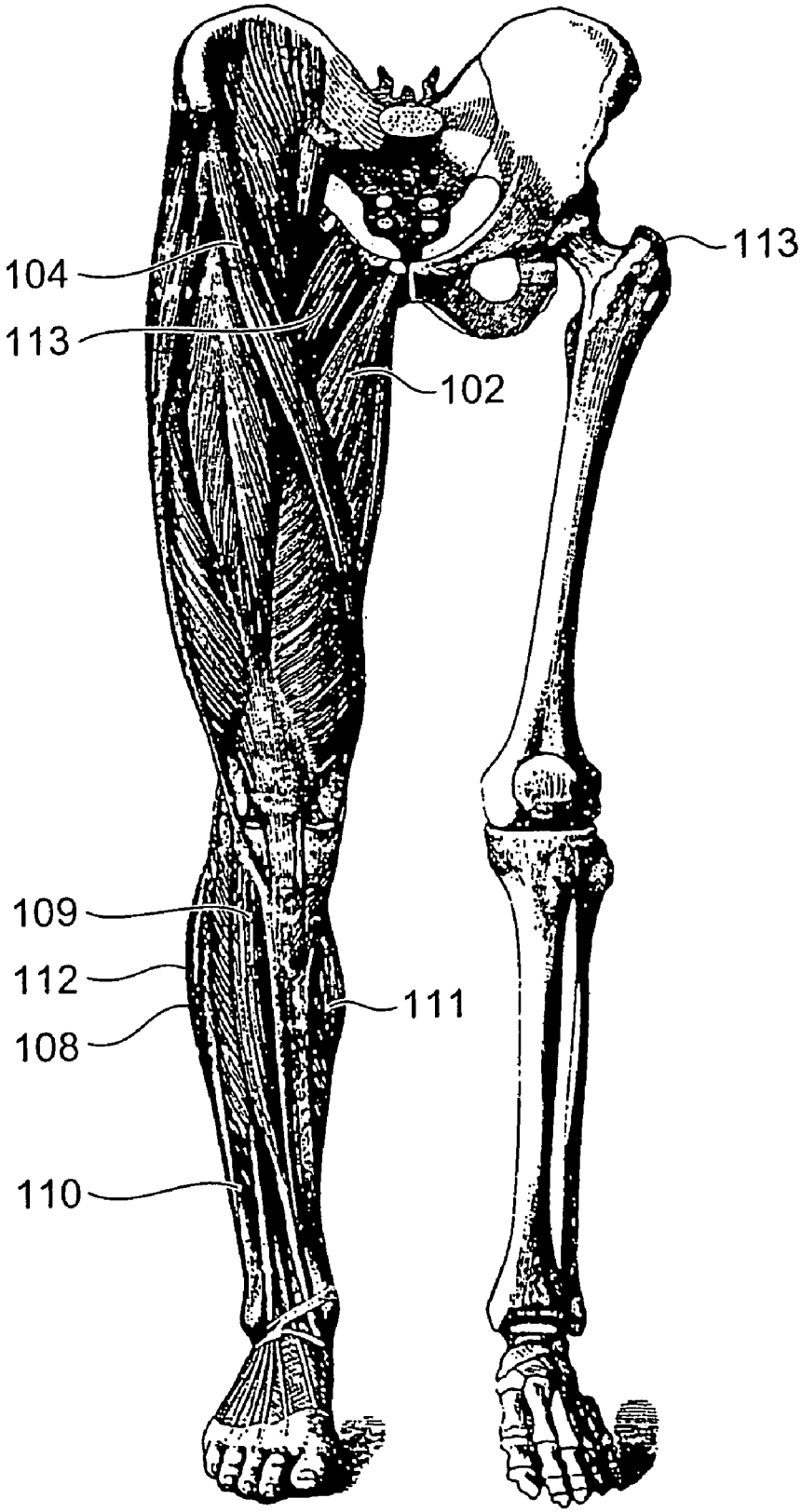
FIG. 1 is a front view showing muscles and bones when the legs of the human body are seen from the front side.

The embodiment of the present invention will be described with reference to the drawings. The same elements are denoted by the same reference numerals, and a repetitive description thereof will be omitted.

Figure 2:
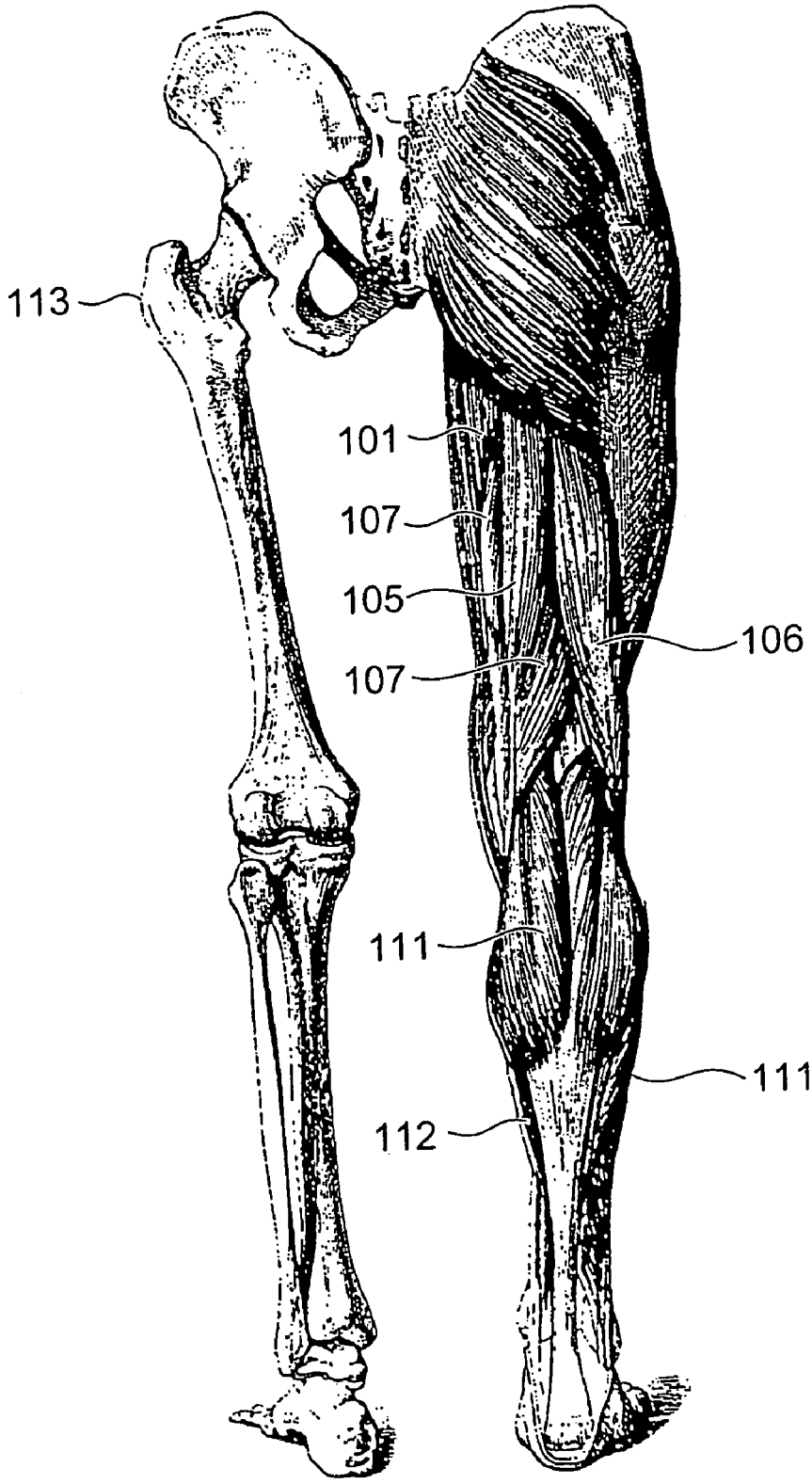
FIG. 2 is a front view showing muscles and bones when the legs of the human body are seen from the rear side.

Prior to a description of the embodiment, the skeletal and muscular system used when describing the function of the present invention will be described with reference to FIGS. 1 and 2. FIG. 1 is a view showing the muscles and bones when the legs of the human body are seen from the front side, and FIG. 2 is a view showing the muscles and bones when the legs of the human body are seen from the rear side. As shown in FIG. 1, a long adductor 102, pectineus 103, and sartorius 104 are arranged in the front side of the thigh, and a long peroneal 108, tribialis anterior 109, long extensor 110 of toes, gastrocnemius 111, and soleus 112 are arranged in the front side of the crus. As shown in FIG. 2, a great adductor 101, semimembranous 105, biceps 106 of the thigh, and semitendinous 107 are arranged in the rear side of the thigh, and the gastrocnemius 111 and soleus 112 are arranged in the rear side of the crus. FIGS. 1 and 2 show a greater trochanter 113. Note that FIGS. 1 and 2 show typical muscles and bones, and the muscles and bones to be supported in the present invention are not limited to them.

Figure 3:
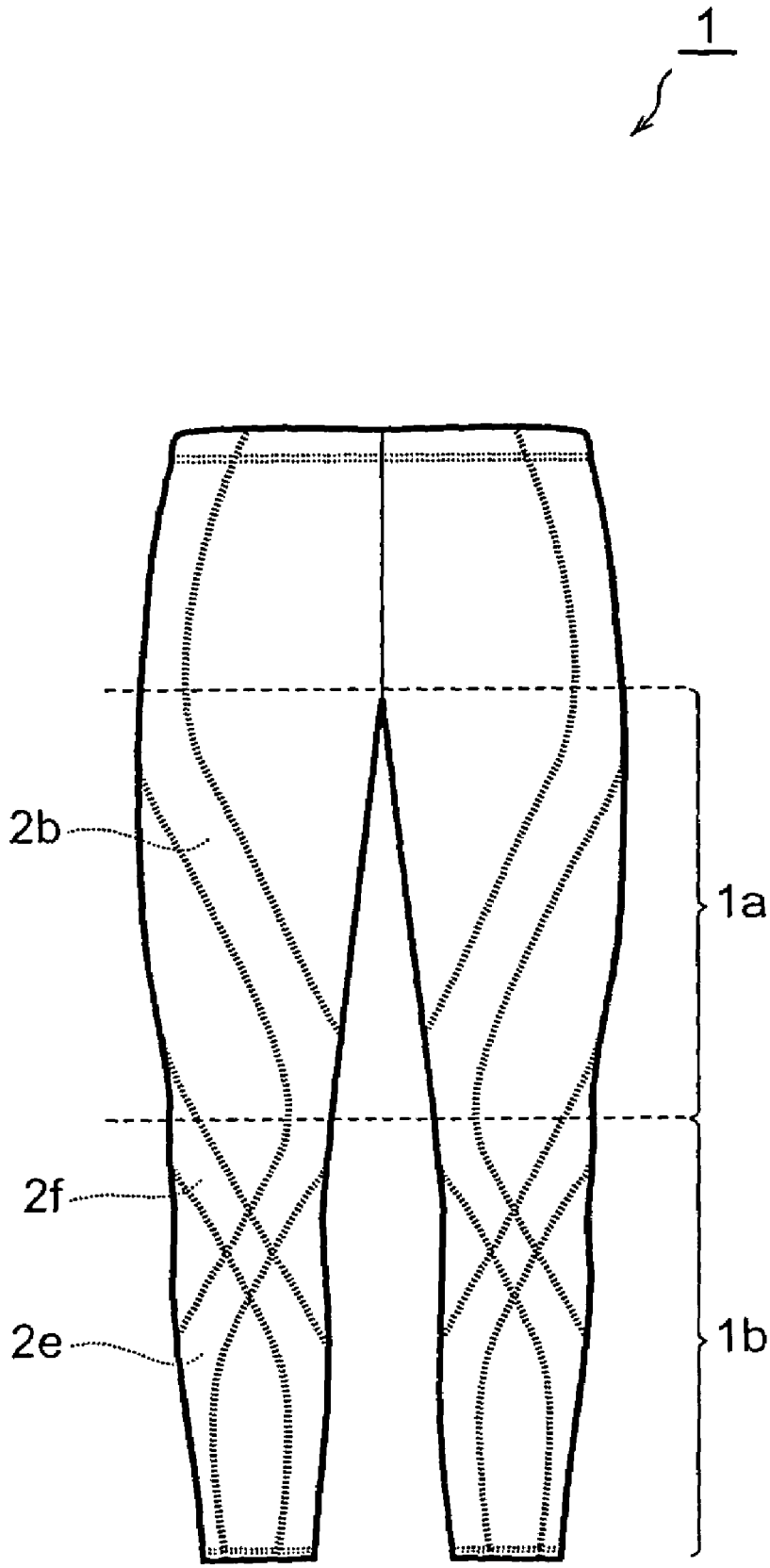
FIG. 3 is a front view of sports spats.

Sports spats 1 (sports pants garment) of this embodiment will be described with reference to FIGS. 3 and 4. FIG. 3 is a front view of sports spats 1, and FIG. 4 is a rear view of the sports spats 1.

Figure 4:
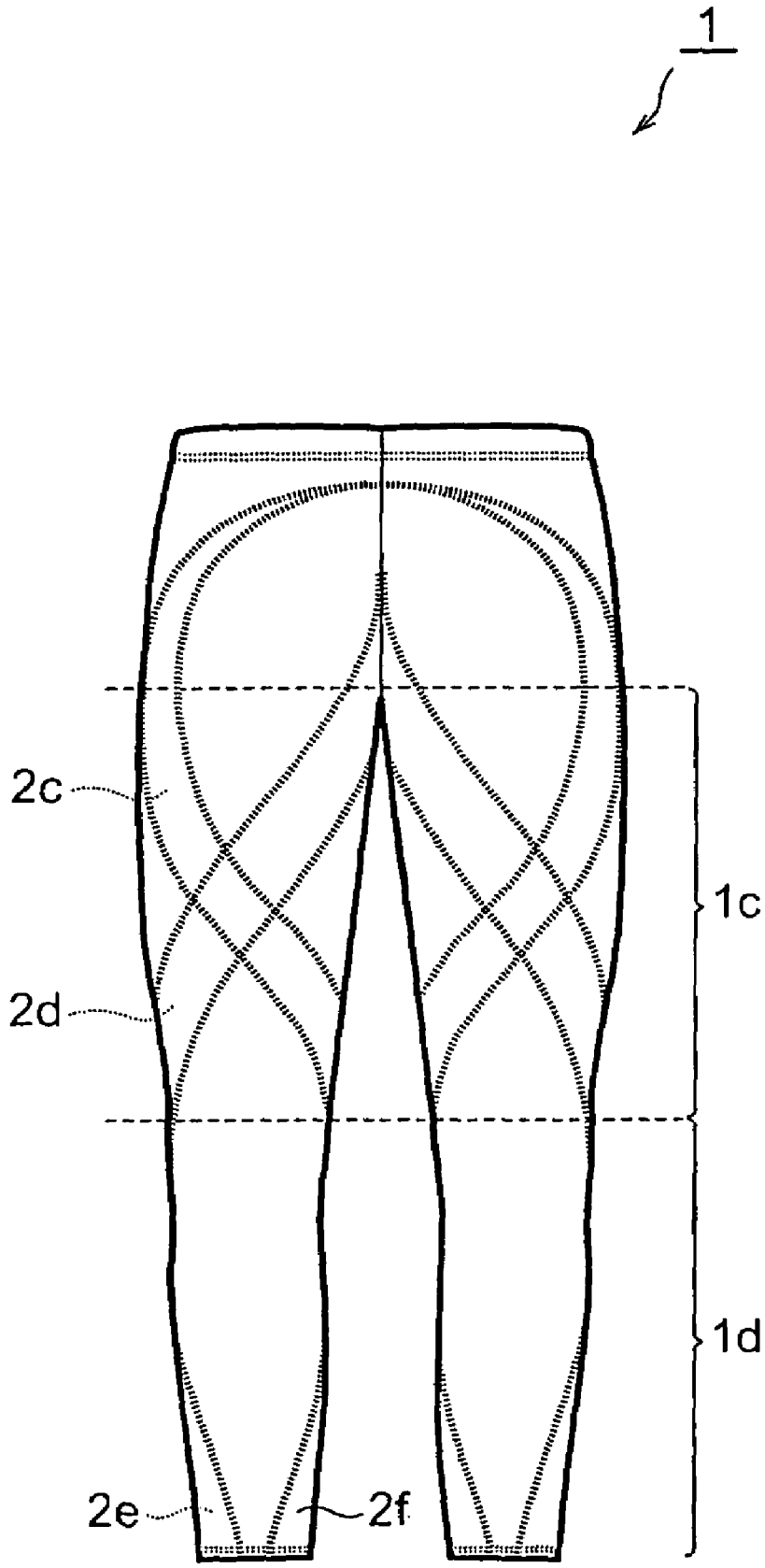
FIG. 4 is a rear view of the sports spats.

As shown in FIGS. 3 and 4, the sports spats 1 cover a range of the hips to the crus, and have band like elastic band members 2. The main body and a elastic band member 2 of the sports spats 1 are formed of a stretchable material. As the stretchable material, for example, power net, satin net, triconet, two way tricot, and two way russel can be raised. In regard to the materials used in the main body and elastic band member 2, the following concrete examples may be cited: for example, two-way tricot (56-dtex polyester yarn with a mixing ratio of 82%, and 55-dtex polyurethane yarn with a mixing ratio of 18%) is used in the main body cloth, and power net (55-dtex nylon yarn with a mixing ratio of 82%, and 310-dtex polyurethane yarn with a mixing ratio of 18%) is used in the elastic band members. In this manner, the elastic band member 2 is formed of a stretchable material in the same manner as the main body portion of the sports spats 1, but the tightening force of the fabric is stronger in the elastic band member 2. This is the characteristic feature of the present invention. Furthermore, it is desirable that the material of the main body cloth have an elongation in two directions.

The width of the elastic band member differs depending on the portion where it is to be formed and on the size of the garment, and accordingly it is difficult to numerically define it simply, but generally a elastic band member is preferably formed with a width of 2 cm or more in average, and more preferably 3 cm on average or more. A elastic band member corresponding to a portion to be supported with a particular focus is preferably formed with a width of 5 cm or more. This will be described in detail. For example, the width of a elastic band member in contact with a calf is preferably about 2 cm to 6 cm, and that of a elastic band member in contact with the inner knee or outer knee is preferably 3 cm or more (more preferably about 5 cm to 10 cm). The width of a elastic band member in contact with a thigh is preferably about 3 cm to 8 cm, and that of a elastic band member in contact with a greater trochanter and hips is preferably 4 cm or more (in some cases, about 8 cm to 15 cm). Furthermore, a wide portion with a width of approximately 20 cm may also be partially formed. Moreover, these numerical values are examples using the M size of a Japanese male as a reference. The aforementioned material regarding the width of the elastic band member also applies to the other embodiments described below.

The elastic band member 2 may be formed of one continuous cloth, or a plurality of cloths. To form the elastic band member 2, it is preferable to overlay a cloth with a strong tightening force on the outer side of a main body cloth that can stretch in two directions. Alternatively, a cloth with a strong tightening force may be overlaid on the inner side of the main body cloth. The method for forming the elastic band members 2 is similar to what is described below with regard to the other embodiments.

For example, if such a elastic band member is formed so as to connect the greater trochanter and the inside surface of the knee, the upper part of the inside of the thigh and the outside surface of the knee or the side surface of the knee and the side surface of the ankle on the opposite side by a shorter distance, tension can be more easily applied to the muscles that contact this elastic band member 2. Furthermore, for example, if the elastic band member has a shape that is linear or close to linear, connection by a shorter distance is possible. However, it is not always necessary that this portion be formed with a linear shape; for example, this portion may also be formed as a curved line in which the straight line that is the shortest line is caused to protrude upward, with both points used as supporting points, or may be formed as a curved line that protrudes downward. Also, the connecting of the elastic band member 2 with the shortest distance possible described above applies to the other embodiments described below as well.

As shown in FIG. 3, the elastic band member 2 has a front thigh elastic band member 2*b* at its portion 1*a* corresponding to the front side of the thigh, and crus front side elastic band members 2*e* and 2*f* at its portion 1*b* corresponding to the front side of the crus. As shown in FIG. 4, the elastic band member 2 has back thigh elastic band members 2*c* and 2*d* at its portion 1*c* corresponding to the rear side of the thigh. The features of the respective elastic band members will be described.

The front thigh elastic band member 2*b* shown in FIG. 3 is, at the portion 1*a* corresponding to the front side of the thigh, formed obliquely from above the outer side to below the inner side of the portion 1*a*. This will be described in more detail. The upper portion of the front thigh elastic band member 2*b* is located at that position of the spats 1 which corresponds to the greater trochanter 113, and the lower portion of the front thigh elastic band member 2*b* is located at that position of the spats 1 which corresponds to the inner side of the knee joint.

The front thigh elastic band member 2*b* is formed in a substantially linear shape across a portion corresponding to the upper greater trochanter and a portion corresponding to the inside of the lower knee joint, and contacts the front surface of the thigh. As a result of such contact, the muscles of the front surface of the thigh are bunched between the upper part and the lower part. Furthermore, as long as the front thigh elastic band member 2*b* is caused to contact the portion extending from the lower inside to the upper outside of the thigh, preferably the portion extending from the inner knee to the greater trochanter, on the front surface of the thigh, the shape may be a linear shape or a shape that is slightly curve upward or downward. That portion of the front thigh elastic band member 2*b* which is above the greater trochanter 113 is formed to extend upward from the greater trochanter 113 along the side portion of the hip.

The front crus elastic band member 2*e* shown in FIG. 3 is, at the portion 1*b* corresponding to the front side of the crus, formed obliquely from above the inner side to below the outer side of the portion 1*b*. To describe this in concrete terms, the upper part of the front crus elastic band member 2*e* is positioned in a portion corresponding to the inside of the knee joint, and the lower part of the front crus elastic band member 2*e* is positioned in a hem portion corresponding to the outside of the ankle. The front crus elastic band member 2*e* is formed to be able to support the long peroneal 108 between its upper and lower portions. With this front crus elastic band member 2*e*, the motion of the long peroneal 108 is supported. The upper portion of the front crus elastic band member 2*e* need not be located at the portion corresponding to the inner side of the knee joint, but suffices as far as it reaches a more inner side (crotch side) and upper side than a portion near the center of the front side surface of the crus. Furthermore, the lower part of the band-form portion formed between the upper part and lower part of the front crus elastic band member 2*e* need not always be formed only on the front side of the crus; as long as the major portion of the elastic band member is on the front side of the crus, a portion of this band-form portion may be continuously formed as far as the portion 1*d* corresponding to the rear side of the crus (see FIG. 4).

The front crus elastic band member 2*f* shown in FIG. 3 is, at the portion 1*b* corresponding to the front side of the crus, formed obliquely from above the outer side to below the inner side of the portion 1*b*. To describe this in concrete terms, the upper part of the front crus elastic band member 2*f* is positioned in a portion corresponding to the outside of the knee joint, and the lower part of the front crus elastic band member 2*f* is positioned in a hem portion corresponding to the inside of the ankle. The front crus elastic band member 2*f* is formed to be able to support the tribialis anterior 109, an extensor hallucis longus (not shown), long extensor 110 of toes, and long peroneal 108 between its upper and lower portions. With the front crus elastic band member 2*f*, the motion of the tribialis anterior 109, extensor hallucis longus, long extensor 110 of toes, and long peroneal 108 is supported. The lower portion of a band like portion formed between the upper and lower portions of the front crus elastic band member 2*f* need not be formed only on the front side of the crus, but may be partly formed at the portion 1*d* corresponding to the rear side of the crus (see FIG. 4).

As shown in FIG. 3, the front crus elastic band member 2*e* and front crus elastic band member 2*f* intersect below the knee, and their upper edges form a V shape. Furthermore, as is shown in FIG. 3, in the portion corresponding to the periphery of the knee, a front thigh elastic band member 2*b* and front crus elastic band member 2*e* are formed in the inside portion of the knee, and a front crus elastic band member 2*f* and back thigh elastic band member 2*d* (see FIG. 4) are formed in the outside portion of the knee. However, no elastic band member is formed in the upper portion of the knee. Thus, as a result of the knee being supported from three directions, i.e., from the left and right side surfaces and from below, the knee ligaments are effectively supported, so that the bending and stretching motion of the knee joint is facilitated. Also, when no elastic band member is formed at the portion above the knee, the knee can follow the motion reliably.

The width of each elastic band member formed at the portion corresponding to the periphery of the knee is preferably 3 cm to 10 cm. The elastic band members may be formed with a constant width within this range, or different widths. Furthermore, in cases where [the respective elastic band members] are formed with different widths, it is desirable that the width of the portions contacting the inner knee in which the ligaments are weak be made wider than the width of other portions, especially the width of the outside knee and area below the knee. Also, the widths of the elastic band members at the areas corresponding to the knees as described above apply to the other embodiments described below as well.

Furthermore, in addition to the elastic band members shown in the FIG. 3, the two elastic band members described next may also be formed. The first elastic band member is a elastic band member which is formed from the inner knee portion of the front crus elastic band member 2*e* shown in FIG. 3 via the inside surface of the calf to the upper part of the calf inside surface contact location of the front crus elastic band member 2*f*. The second elastic band member is a elastic band member which is formed from the outer knee portion of the front crus elastic band member 2*f* shown in FIG. 3 via the outside surface of the calf to the upper part of the calf outside surface contact location of the front crus elastic band member 2*e*. Both of these two elastic band members may be formed, or only one or the other of these two elastic band members may be formed. As a result of the formation of such elastic band members, it becomes easier to apply tension to the inside, outside and lower side of the knee, so that the effect supporting the knee is heightened. Furthermore, as a result of these elastic band members contacting the calf, the calf can be supported. Moreover, tension can be applied most easily in a case where these two elastic band members are formed in a rectilinear shape, so that such a shape is ideal; however, these elastic band members may also show some curvature. Furthermore, since it is sufficient if tension can be applied between these two elastic band members and other elastic band members connected to these respective elastic band members, these two elastic band members may be formed with a narrower width than the other elastic band members.

The back thigh elastic band member 2*c* shown in FIG. 4 is, at the portion 1*c* corresponding to the rear side of the thigh, formed obliquely from above the outer side to below the inner side of the portion 1*c*. This will be described in more detail. The upper portion of the back thigh elastic band member 2*c* is located at a portion corresponding to the greater trochanter 113, and the lower portion of the back thigh elastic band member 2*c* is located at a portion corresponding to the inner side of the knee joint. The back thigh elastic band member 2*c* is formed to be able to support the semimembranous 105 between its upper and lower portions. Furthermore, the upper part of the back thigh elastic band member 2*c* need not always be positioned in a portion corresponding to the greater trochanter 113; it is sufficient if this elastic band member at least extends beyond the vicinity of the center of the upper part of the thigh on the rear side surface. Furthermore, the portion of the back thigh elastic band member 2*c* that is located above the greater trochanter 113 contacts the side part of the pelvic region from the greater trochanter 113, and is formed toward the upper part of the rear center; moreover, this portion contacts the upper part of the swell of the hip (upper part of the pelvic region), and the end portions of the back thigh elastic band member 2*c* on the left and right are formed so that these end portions are connected in the vicinity of the rear center of the waistline (upper part of the pelvic region). Furthermore, the back thigh elastic band member 2*c* may also connect with the front thigh elastic band member 2*b* shown in FIG. 3 at the side part of the pelvic region. As a result of such a connection of the back thigh elastic band member 2*c* and front thigh elastic band member 2*b* at the side part of the pelvic region, tension is mutually applied, so that the supporting effect of the thigh muscles is increased; furthermore, the hip joint can be supported. Moreover, as a result of the back thigh elastic band member 2*c* or front thigh elastic band member 2*b* contacting the side part of the pelvic region including the greater trochanter 113, the hip joint can be supported. Furthermore, as a result of the left and right back thigh elastic band members 2*c* being connected at the rear center of the pelvic region, or the left and right front thigh elastic band members 2*b* being connected at the front center of the abdomen, the effect of supporting the hip joints is further increased. In cases where the left and right back thigh elastic band members 2*c* are connected at the rear center of the pelvic region, it is desirable that the connection location be disposed on the upper part of the pelvic region.

The back thigh elastic band member 2*d* shown in FIG. 4 is, at the portion 1*c* corresponding to the rear side of the thigh, formed obliquely from above the inner side to below the outer side of the portion 1*c*. This will be described in more detail. The upper portion of the back thigh elastic band member 2*d* is located at a portion corresponding to a portion near the hip bone connecting point (portion below the natal cleft), and the lower portion of the back thigh elastic band member 2*d* is located at a portion corresponding to the outer side of the knee joint. The back thigh elastic band member 2*d* is formed to be able to support the biceps 106 of thigh, semitendinous 107, and semimembranous 105 between its upper and lower portions. With the back thigh elastic band member 2*d*, the motion of the biceps 106 of thigh, semitendinous 107, and semimembranous 105 is supported. Furthermore, the upper ends of the back thigh elastic band members 2*d* on the left and right thighs are connected in the vicinity of the joining point of the hip bones. As a result, tension is mutually applied to the back thigh elastic band members 2*d* on the left and right. Furthermore, the upper parts of the back thigh elastic band members 2*d* may be positioned at the inside upper parts (below the crotch) on the rear sides of the thighs. Moreover, the upper parts of the back thigh elastic band members 2*d* may contact the natal cleft and extend to the waistline, or may contact the natal cleft and connect with other elastic band members at the rear center of the upper part of the pelvic region. As a result, more tension is applied to the back thigh elastic band members 2*d*, so that the effect of supporting the muscles is improved.

Since the back thigh elastic band member 2*c* and back thigh elastic band member 2*d* are not formed above the natal cleft, as shown in FIG. 4, stretch of the hips is secured. Accordingly, for example, even when the wearer bends his body forward, the garment can follow this motion easily.

As is shown in FIGS. 3 and 4, the front thigh elastic band member 2*b* and back thigh elastic band member 2*c* are connected in their respective upper parts at a portion including the greater trochanter from the upper outside of the thigh, and are connected in their respective lower parts at the inside of the knee from the lower inside of the thigh. In this case, the elastic band members that contact the front and back of the thigh are connected respectively at the side part of the hip joint above the outside of the thigh and the inner knee below the inside of the thigh. Specifically, the elastic band members that contact the front and back of the thigh are connected on both the inside and outside of the thigh. As a result, a tightening force can be applied to both the knee joint and the hip joint, so that both the knee joint and hip joint can be stabilized and supported. On the inner side of the knee, the upper portion of the front crus elastic band member 2*e* is connected to the front thigh elastic band member 2*b* and back thigh elastic band member 2*c* described above. The lower portion of the back thigh elastic band member 2*d* and the upper portion of the front crus elastic band member 2*e* are connected to each other on the outer side of the knee. Not both the back thigh elastic band member 2*d* and back thigh elastic band member 2*c* need be formed, but only either elastic band member may be formed. Either one of the back thigh elastic band member 2*d* and back thigh elastic band member 2*c* may only form a portion below the intersecting portion of the two elastic band members. It would also be possible to have only the front thigh elastic band member 2*b* and the back thigh elastic band member 2*c* formed. In this case, the inner knee and the side of the hip can be stabilized by connecting the inner knee and the greater trochanter with the front thigh elastic band member 2*b* and the back thigh elastic band member 2*c*. Or, only the front thigh elastic band member 2*b* and the back thigh elastic band member 2*d* can be formed. In this case, the knee can be stabilized by further forming an elastic member below the knee, as described later, thereby providing opposing tension at the front and rear of the thigh with the elastic member below the knee and the portions abutting the outer knee and the inner knee. Also, the front thigh elastic band member 2*b* can be formed so that it does not abut the area directly above the knee, thereby providing a greater degree of freedom for the knee.

In this manner, when the thigh is supported from front and behind with the front thigh elastic band member and back thigh elastic band member, the hip joint and knee joint can pivot inwardly and outwardly and rotate inwardly and outwardly easily. As the knee is supported from the left, right, and lower directions by part of the elastic band member, the knee is stabilized, so the knee joint can bend and stretch easily. Hence, sports spats suitable for supporting the operation of the muscles during an exercise that uses legs can be provided.

Furthermore, the front thigh elastic band members, back thigh elastic band members and crus front side elastic band members are connected to each other (continuous with each other) at either the waste, thighs, knees or crus, and the left and right back thigh elastic band members are connected above and below the rear center of the pelvic region. As a result, the respective elastic band members have a structure that applies tension with the rear center of the pelvic region (location of contact of the spine and pelvis) as a supporting point, so that tension is applied to the lower half of the body with the core of the body as a center. Accordingly, the muscles and joints of the pelvic region, thighs, knees and crus can be supported with good balance.

Furthermore, in the sports spats 1 shown in FIGS. 3 and 4, one elastic band member 2*b* is disposed on the front side of the thigh, and two elastic band members 2*c* and 2*d* are disposed on the rear side of the thigh. By thus disposing a larger number of elastic band members on the rear side of the thigh than on the front side of the thigh, it is possible to improve the supporting effect when the thigh is caused to operate in the forward-rearward direction. This type of advantage is also provided in the other embodiments described below.

Modifications of the elastic band member 2 of the sports spats according to this embodiment will be described with reference to FIGS. 5 to 8.

Figure 5:
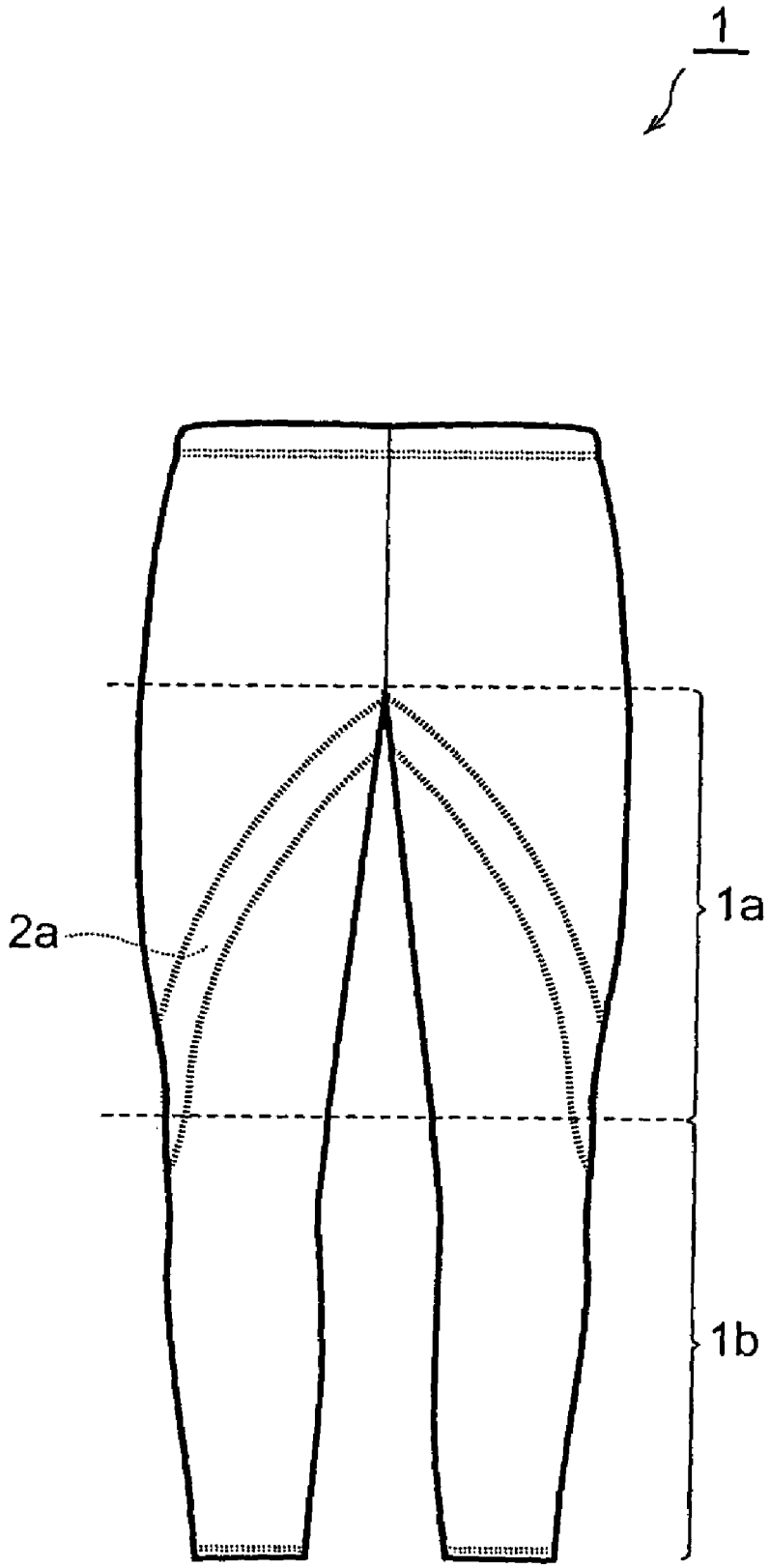
FIG. 5 is a front view of sports spats.

FIG. 5 is a front view of sports spats 1 and shows a front thigh elastic band member 2*a* formed at a portion 1*a* corresponding to the front side of the thigh. The front thigh elastic band member 2*a* shown in FIG. 5 is, at the portion 1*a* corresponding to the front side of the thigh, formed obliquely from above the inner side to below the outer side of the portion 1*a*. To describe this in concrete terms, the upper part of the front thigh elastic band member 2*a* is positioned in a portion corresponding to the inside of the thigh below the crotch (upper inside of the thigh), and the lower part of the front thigh elastic band member 2*a* is positioned in a portion corresponding to the outside of the knee joint. Here, the muscles of the thigh are bunched obliquely from the upper part to the lower part, so that the contractile motion in the muscles in this interval is supported. Accordingly, as a result of the front thigh elastic band member 2*a* being formed obliquely from the upper part to the lower part of the thigh, and [thus] being formed so that the pectineus 103, short adductor (not shown in the figures), long adductor 102 and great adductor 101 can be supported, the motions of the pectineus 103, short adductor, long adductor 102 and great adductor 101 are supported. Furthermore, the lower part of the front thigh elastic band member 2*a* need not always be positioned in a portion corresponding to the outside of the knee joint; it is sufficient if this elastic band member 2*a* reaches at least a point that is further to the outside (flank side) than the vertical center line on the front side of the thigh, i.e., reaches the lower part of the outside of thigh.

Figure 6:
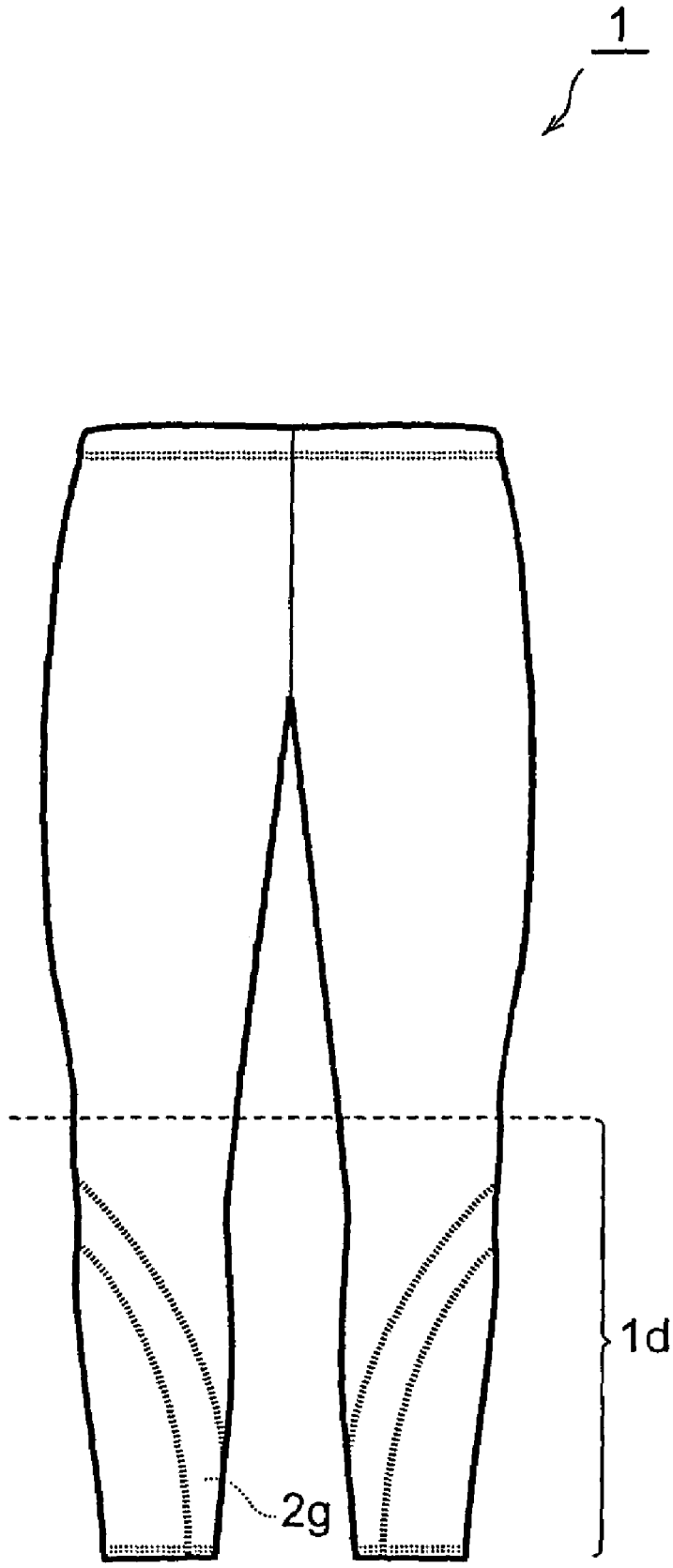
FIG. 6 is a rear view of the sports spats.

FIG. 6 is a rear view of sports spats 1 and shows a back crus elastic band member 2*g* formed at a portion 1*d* corresponding to the rear side of the crus. The back crus elastic band member 2*g* shown in FIG. 6 is, at the portion 1*d* corresponding to the rear side of the crus, formed obliquely from above the outer side to below the inner side of the portion 1*d*. To describe this in concrete terms, the upper part of the back crus elastic band member 2*g* is positioned in a portion corresponding to the outside of the knee joint or the area below the outside of the knee joint, and the lower part of the back crus elastic band member 2*g* is positioned in a hem portion corresponding to the inside of the ankle. The back crus elastic band member 2*g* is formed to be able to support the gastrocnemius 111, rear peroneal (not shown), and soleus 112 between its upper and lower portions. With the back crus elastic band member 2*g*, the motion of the gastrocnemius 111, rear peroneal, and soleus 112 is supported. Furthermore, the band-form portion formed between the upper part and lower part of the back crus elastic band member 2*g* need not always be formed on only the rear side of the crus; a portion of this band-form portion may also be formed in a portion corresponding to the front side of the crus.

Figure 7:
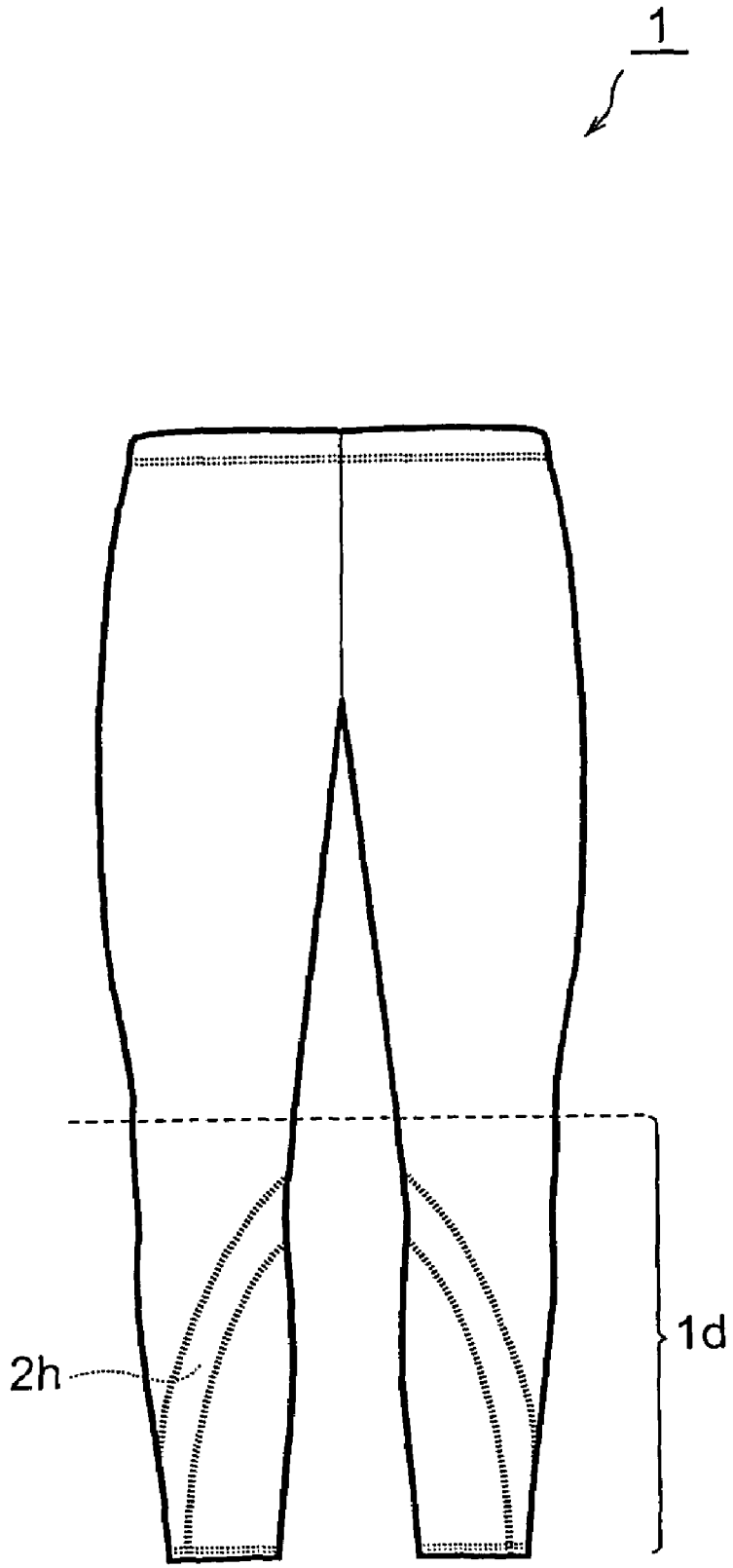
FIG. 7 is a rear view of the sports spats.

FIG. 7 is a rear view of sports spats 1 and shows a back crus elastic band member 2*h* formed at a portion 1*d* corresponding to the rear side of the crus. The back crus elastic band member 2*h* shown in FIG. 7 is, at the portion 1*d* corresponding to the rear side of the crus, formed obliquely from above the inner side to below the outer side of the portion 1*d*. To describe this in concrete terms, the upper part of the back crus elastic band member 2*h* is positioned in a portion corresponding to the inside of the knee joint or the area below the inside of the knee joint, and the lower part of the back crus elastic band member 2*h* is positioned in a hem portion corresponding to the outside of the ankle. The back crus elastic band member 2*h* is formed to be able to support the gastrocnemius 111 and soleus 112 between its upper and lower portions. With the back crus elastic band member 2*h*, the motion of the gastrocnemius 111 and soleus 112 is supported. Furthermore, the band-form portion formed between the upper part and lower part of the back crus elastic band member 2*h* need not always be formed on only the rear side of the crus; a portion of this band-form portion may also be formed in a portion corresponding to the front side of the crus.

Figure 8:
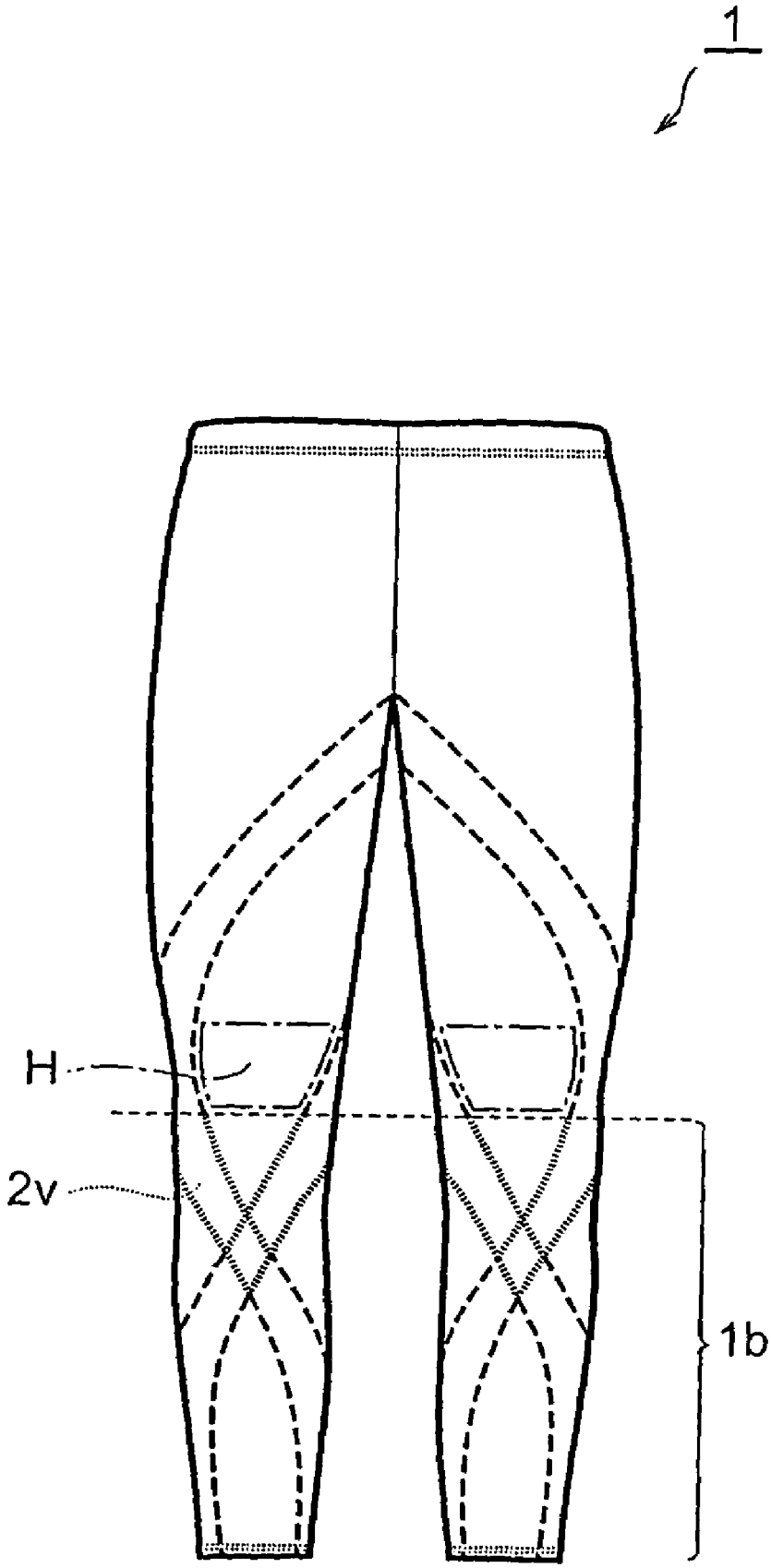
FIG. 8 is a front view of sports spats.

FIG. 8 is a front view of sports spats 1 and shows a below-the-knee elastic band member 2*v* formed at a portion 1*b* corresponding to the front side of the crus. The below-the-knee elastic band member 2*v* (portion indicated by a solid line) shown in FIG. 8 is formed to extend from a portion corresponding to the inner side of the knee joint and the outer side of the knee joint to a portion on the lower side of the knee joint, and the upper edge of the below-the-knee elastic band member 2*v* forms a V shape. Accordingly, the wearer's knee is firmly supported from the inner, outer, and lower sides of the knee, so any unwanted motion of the knee is suppressed, and the knee can stretch easily. As the below-the-knee elastic band member 2*v* is formed, the bending motion of the knee is suppressed, so the patellar ligament below the knee can be protected. The upper edge of the below-the-knee elastic band member 2*v* need not form a V shape, but may form, e.g., a U shape or crescent shape. In other words, the shape of the upper edge of the below-the-knee elastic band member 2*v* suffices as far as it forms a recess toward the lower portion of the crus. The below-the-knee elastic band member 2*v* may be formed by intersecting two elastic band members below the knee. As shown in FIG. 8, the portion corresponding to the upper side of the knee is formed of a soft elastic band member H having a softer tightening force than that of the elastic band member 2, so that a decrease in the performance of the knee to follow the motion can be suppressed. The main body portion (excluding the elastic band member 2) and soft elastic band member H of the sports spats suffice as far as they are formed of cloths having softer tightening forces than that of the elastic band member 2, or the main body portion (excluding the elastic band member 2) and soft elastic band member H may be formed of one cloth integrally.

With the elastic band member 2 of this embodiment, even when the respective portions described above are combined as will be described later, the same effect as that of the elastic band member in which the respective portions are combined as shown in FIGS. 3 and 4 can be obtained.

Regarding the combination of the portion corresponding to the thigh, the front thigh elastic band member 2*a* and back thigh elastic band member 2*d* may be combined. This combination supports the inner rotating motion of the knee and the outer knee. In particular, this combination has the effect of supporting the knee not to turn to the outer side when the wearer lands on his feet. The front thigh elastic band member 2*b* and back thigh elastic band member 2*c* may be combined. This combination supports the greater trochanter and the inner knee. When the greater trochanter is supported, the hip joint is supported, so the hip joint can bend and stretch easily. When the front thigh elastic band member and back thigh elastic band member combined in this manner are seen from either the front or rear side of the spats 1, the respective elastic band members incline in the same direction with respect to the vertical direction. Furthermore, it is desirable that the vertical width of the connecting portions of the elastic band members that are thus combined on the outside of the thigh and inside of the thigh be 5 cm or greater. Preferably, the vertical width of the connecting portions on the outside of the thigh is set at approximately 5 to 15 cm, and the vertical width of the connecting portions on the inside of the thigh is set at approximately 5 to 10 cm. The description concerning these widths also applies to other embodiments. When a elastic band member for supporting the middle gluteus (muscle in the upper portion of the hips) is added to this combination of elastic band member, the outer pivoting motion of the hip joint can be supported.

The front thigh elastic band member 2*a* and back thigh elastic band member 2*c* may be combined. This combination supports the inner rotating motion of the knee and the inner rotating motion of the hip joint. The front thigh elastic band member 2*b* and back thigh elastic band member 2*d* may be combined. This combination supports the outer rotating and outer pivoting motion of the knee. When the front thigh elastic band member and back thigh elastic band member combined in this manner are seen from either the front or rear side of the spats 1, the respective elastic band members incline in opposite directions with respect to the vertical direction.

In this manner, when the thigh is supported from front and behind with the front thigh elastic band member and back thigh elastic band member, the hip joint and knee joint can pivot inwardly and outwardly and rotate inwardly and outwardly easily. As the knee is supported from the left and right by part of the front thigh elastic band member and part of the back thigh elastic band member, the knee joint can bend and stretch easily.

Regarding the combination of the portion corresponding to the crus, the front crus elastic band member 2*e* and back crus elastic band member 2*h* may be combined. This combination supports the inner rotating motion of the knee and the inner knee. The front crus elastic band member 2*f* and back crus elastic band member 2*g* may be combined. This combination supports the outer rotating motion of the knee and the outer knee. When the front crus elastic band member and back crus elastic band membercombined in this manner are seen from either the front or rear side of the spats 1, the respective elastic band members incline in the same direction with respect to the vertical direction.

The front crus elastic band member 2*e* and back crus elastic band member 2*g* may be combined. This combination supports the outer pivoting motion of the knee and the outer pivot of the crus. Hence, for example, an inside kick motion and the like in soccer are supported. The front crus elastic band member 2*f* and back crus elastic band member 2*h* may be combined. This combination supports the outer pivoting motion of the knee. When the front crus elastic band member and back crus elastic band member combined in this manner are seen from either the front or rear side of the spats 1, the respective elastic band members incline in opposite directions with respect to the vertical direction.

In this manner, when the crus is supported from front and behind with the front crus elastic band member and crus rear side elastic band member, the knee joint and ankle can pivot inwardly and outwardly and rotate inwardly and outwardly easily. As the knee is supported from the left and right by part of the front crus elastic band member and part of the crus rear side elastic band member, the knee joint can bend and stretch easily.

Figure 9B:
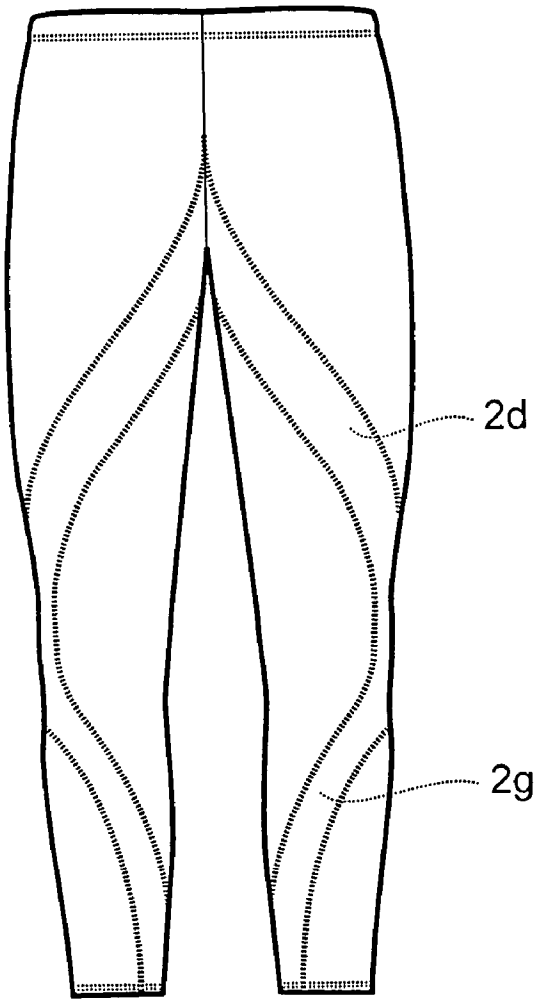
FIG. 9B is a rear view of the sports spats.
Figure 9A:
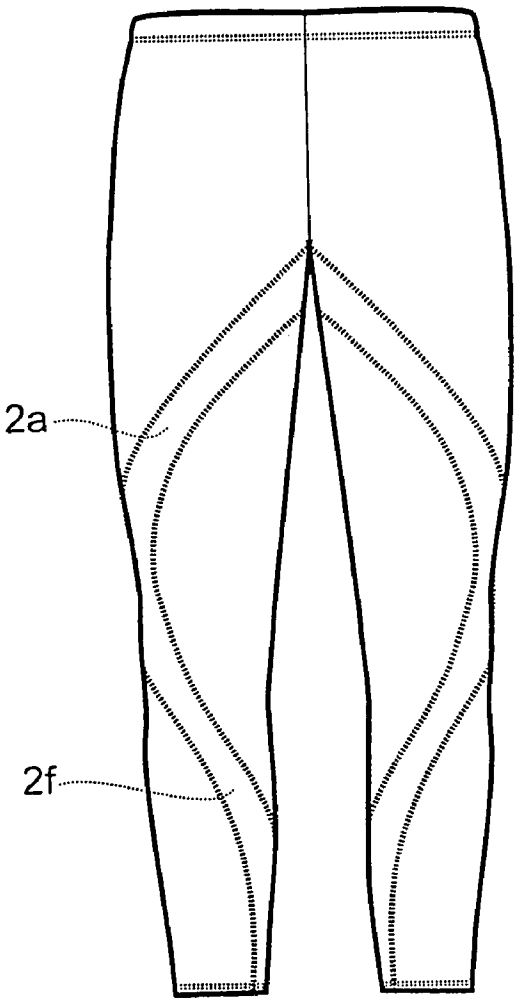
FIG. 9A is a front view of sports spats.

The respective combinations of the portion corresponding to the thigh described above and the respective combinations of the portion corresponding to the crus described above may be combined. Practical examples of such case will be described with reference to FIGS. 9A to 10B. FIG. 9A is a front view of sports spats and shows a state wherein a front thigh elastic band member 2*a* and front crus elastic band member 2*f* are combined on the front side of the leg. FIG. 9B is a rear view of the sports spats and shows a state wherein a back thigh elastic band member 2*d* and back crus elastic band member 2*g* are combined on the rear side of the leg. In the spats shown in FIGS. 9A and 9B, on the thigh, the front thigh elastic band member 2*a* and back thigh elastic band member 2*d* are formed to incline in the same direction, and on the crus, the front crus elastic band member 2*f* and back crus elastic band member 2*g* are formed to incline in the same direction. When the respective elastic band members are formed in this manner, the wearer's thigh and crus are firmly supported from front and behind. Furthermore, the respective elastic band members are connected in a portion corresponding to the outside of the knee. Accordingly, since the elastic band member contacting the outside of the knee is pulled in four directions by the respective elastic band members, the outside of the wearer's knee is firmly supported. In this case, furthermore, another elastic band member which contacts the inside of the knee so that the inside of the knee can be supported may also be formed. As a result, the wearer's knee is firmly supported from the inside and the outside. Furthermore, by connecting both the front crus elastic band member 2*f* and back crus elastic band member 2*g* at the lower part of the inside of the crus, it is possible to apply more tension to the respective elastic band members. Also, it would be preferable for the bottom end of the back crus elastic band member 2*g* and the front crus elastic band member 2*f* to extend to the edge of the spats.

Figure 10B:
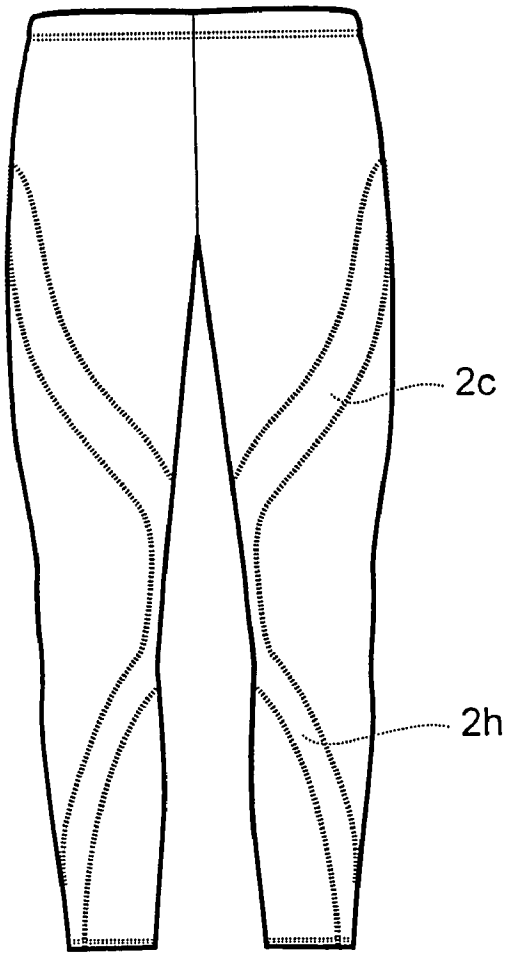
FIG. 10B is a rear view of the sports spats.
Figure 10A:
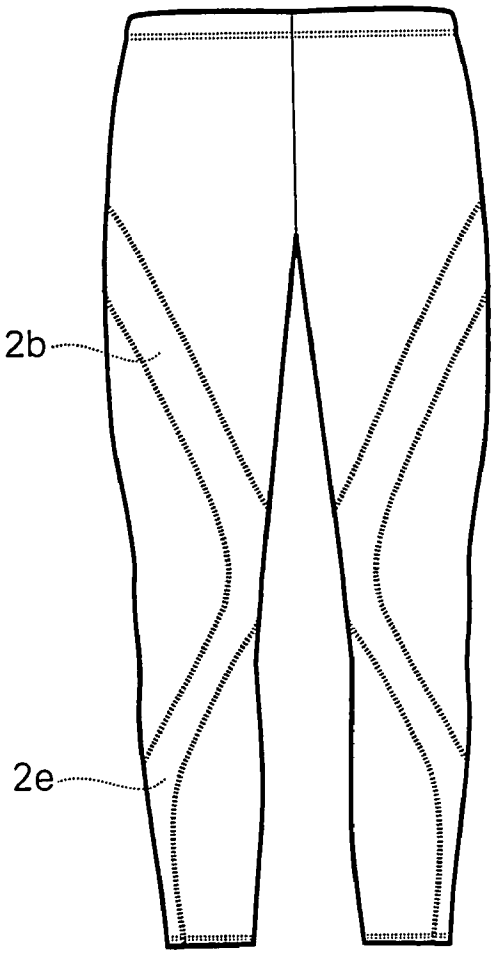
FIG. 10A is a front view of sports spats.

FIG. 10A is a front view of sports spats and shows a state wherein a front thigh elastic band member 2*b* and front crus elastic band member 2*e* are combined on the front side of the leg. FIG. 10B is a rear view of the sports spats and shows a state wherein a back thigh elastic band member 2*c* and back crus elastic band member 2*h* are combined on the rear side of the leg. In the spats shown in FIGS. 10A and 10B, on the thigh, the front thigh elastic band member 2*b* and back thigh elastic band member 2*c* are formed to incline in the same direction, and on the crus, the front crus elastic band member 2*e* and back crus elastic band member 2*h* are formed to incline in the same direction. Furthermore, the upper part of the front thigh elastic band member 2*b* and the upper part of the back thigh elastic band member 2*c* contact the greater trochanter, and are connected to each other. When the respective elastic band members are formed in this manner, the wearer's thigh and crus are firmly supported from front and behind. As the elastic band member in contact with the inner side of the knee is pulled by the respective elastic band members in four directions, the inner side of the wearer's knee is supported firmly. In this case, another elastic band member may also be formed so that the outer side of the knee can be supported. Then, the wearer's knee is firmly supported from the inner and outer sides. Also, by connecting the elastic band members at the below the outer lower thigh, the front crus elastic band member 2*e* and the back crus elastic band member 2*h* can apply more tension to the elastic band members. Also, it would be preferable for the bottom end of the back crus elastic band member 2*h* and the front crus elastic band member 2*e* to extend to the edge of the spats.

Figure 11B:
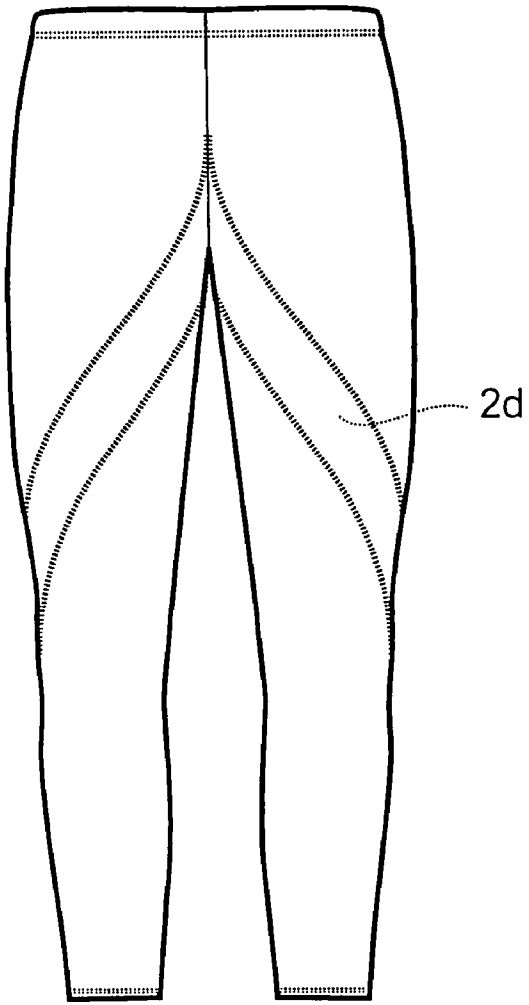
FIG. 11B is a rear view of the sports spats.
Figure 11A:
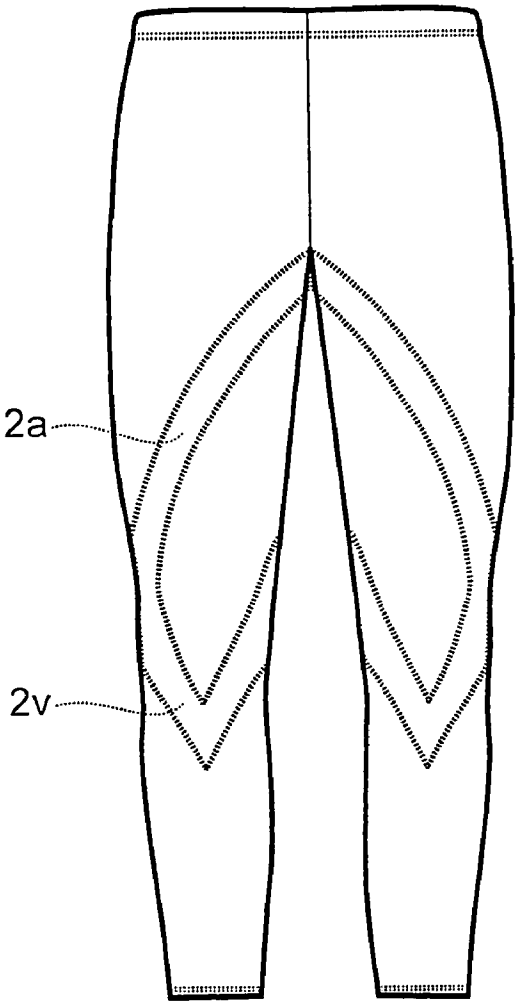
FIG. 11A is a front view of sports spats.

The respective combinations of the portion corresponding to the thigh described above and the below-the-knee elastic band member 2*v* described above may be combined. Practical examples of such case will be described with reference to FIGS. 11A to 12B. FIG. 11A is a front view of sports spats and shows a state wherein a front thigh elastic band member 2*a* and below-the-knee elastic band member 2*v* are combined on the front side of the leg. FIG. 11B is a rear view of the sports spats and shows a state wherein a back thigh elastic band member 2*d* is formed on the rear side of the leg. In the spats shown in FIGS. 11A and 11B, on the thigh, the front thigh elastic band member 2*a* and back thigh elastic band member 2*d* are formed to incline in the same direction. The lower portion of the front thigh elastic band member 2*a*, the lower portion of the back thigh elastic band member 2*d*, and the upper portion on the outer knee side of the below-the-knee elastic band member 2*v* are connected to each other at the outer knee portion. When the respective elastic band members are formed in this manner, the wearer's thigh is firmly supported from front and behind. As the below-the-knee elastic band member 2*v* is in contact with the inner, outer, and lower sides of the knee and is pulled obliquely upward by the elastic band members formed on the front and rear sides of the thigh, the wearer's knee is firmly supported in three directions. In cases where the elastic band member thus does not contact the area above the knee, the degree of freedom of the knee is ensured, so that movement tracking is improved. On the other hand, in cases where the elastic band member contacts the area above the knee, the stability of the knee is improved, but movement tracking deteriorates. Alternatively, a back thigh elastic band member 2*c* may be further formed on the spats shown in FIGS. 11A and 11B. In this case, the lower portion of the back thigh elastic band member 2*c* and the inner knee side upper portion of the below-the-knee elastic band member 2*v* are connected to each other at the inner knee portion. Then, that portion of the below-the-knee elastic band member 2*v* which is in contact with the inner knee is pulled upward toward the outer side of the thigh by the back thigh elastic band member 2*c*, and that portion of the below-the-knee elastic band member 2*v* which is in contact with the outer knee is pulled upward toward the inner side of the thigh by the front thigh elastic band member 2*a* and back thigh elastic band member 2*d*. Specifically, the inner knee side contacting part and outer knee side contacting part of the below-the-knee elastic band member 2*v* are pulled in respectively opposite directions on the front and back of the thigh, so that the force supporting the knee is increased. Another elastic band member may be further formed to connect to the inner knee side upper portion of the below-the-knee elastic band member 2*v*, and the upper portion of the elastic band member may be connected to the front thigh elastic band member 2*a* or back thigh elastic band member 2*d*. Furthermore, the front thigh elastic band member 2*b*, back thigh elastic band member 2*c* and below-the-knee elastic band member 2*v* may be combined. In this case, the lower portion of the front thigh elastic band member 2*b*, the lower portion of the back thigh elastic band member 2*c*, and the inner knee side upper portion of the below-the-knee elastic band member 2*v* are connected to each other at the inner knee portion. Furthermore, if a elastic band member that connects the lower part of the below-the-knee elastic band member 2*v* and the hem of the sports spats is further installed, more tension is applied to the elastic band members located below the knee and on the inside and outside of the knee, so that the supporting effect is improved. Moreover, the elastic band member that connects the lower part of the below-the-knee elastic band member 2*v* and the hem of the sports spats may be a single elastic band member; however, tension can be applied more easily by forming two elastic band members so that the below-the-knee elastic band member 2*v* is pulled downward to the left and right. It would also be possible to have only the front thigh elastic band member 2*a* and the back thigh elastic band member 2*d* formed without forming the below-the-knee elastic band member 2*v*.

Figure 12B:
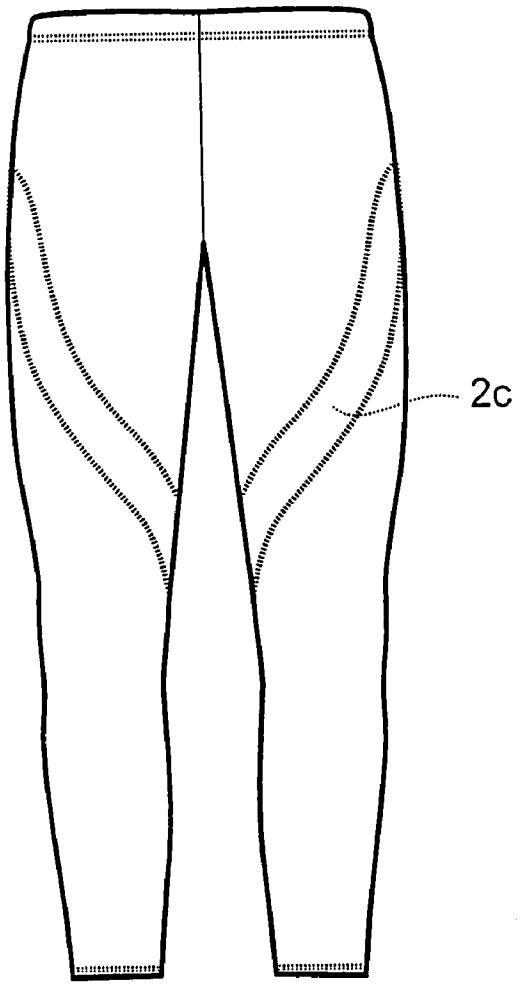
FIG. 12B is a rear view of the sports spats.
Figure 12A:
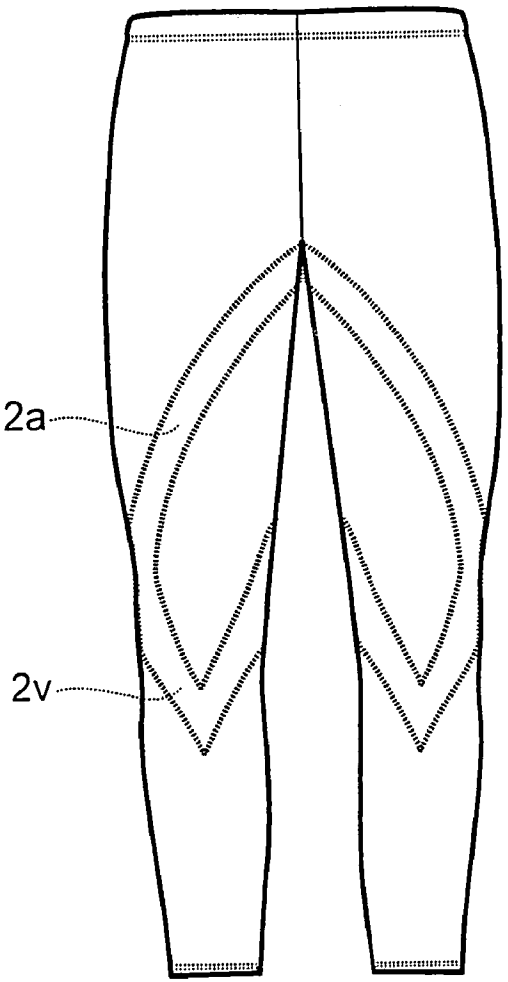
FIG. 12A is a front view of sports spats.

FIG. 12A is a front view of sports spats and shows a state wherein a front thigh elastic band member 2*a* and below-the-knee elastic band member 2*v* are combined on the front side of the leg. FIG. 12B is a rear view of the sports spats and shows a state wherein a back thigh elastic band member 2*c* is formed on the rear side of the leg. In the spats shown in FIGS. 12A and 12B, on the thigh, the front thigh elastic band member 2*a* and back thigh elastic band member 2*c* are formed to incline in opposite directions. The lower portion of the front thigh elastic band member 2*a* and the outer knee side upper portion of the below-the-knee elastic band member 2*v* are connected to each other at the outer knee portion. The upper portion of the back thigh elastic band member 2*c* is in contact with the greater trochanter. When the respective elastic band members are formed in this manner, the wearer's thigh is firmly supported from front and behind. As the below-the-knee elastic band member 2*v* is in contact with the inner, outer, and lower sides of the knee and is pulled obliquely upward by the elastic band members formed on the front and rear sides of the thigh, the wearer's knee is firmly supported in three directions. In cases where the elastic band member thus does not contact the area above the knee, the degree of freedom of the knee is ensured, so that movement tracking is improved. On the other hand, in cases where the elastic band member contacts the area above the knee, the stability of the knee is improved, but movement tracking deteriorates. A back thigh elastic band member 2*c* may be further formed on the spats shown in FIGS. 12A and 12B. In this case, the lower portion of the back thigh elastic band member 2*c* and the inner knee side upper portion of the below-the-knee elastic band member 2*v* are connected to each other at the inner knee portion. Another elastic band member may be further formed to connect to the inner knee side upper portion of the below-the-knee elastic band member 2*v*, and the upper portion of the elastic band member may be connected to the front thigh elastic band member 2*a* or back thigh elastic band member 2*c*. Alternatively, the front thigh elastic band member 2*b*, front thigh elastic band member 2*d* and blow-knee elastic band member 2*v* may be combined together. In this case, the lower portion of the front thigh elastic band member 2*b* and the inner knee side upper portion of the below-the-knee elastic band member 2*v* are connected to each other at the inner knee portion, and the lower portion of the back thigh elastic band member 2*d* and the outer knee side upper portion of the below-the-knee elastic band member 2*v* are connected to each other at the outer knee portion. Furthermore, if a elastic band member that connects the lower part of the below-the-knee elastic band member 2*v* and the hem of the sports spats is further installed, more tension is applied to the elastic band members located below the knee and on the inside and outside of the knee, so that the supporting effect is improved. Moreover, the elastic band member that connects the lower part of the below-the-knee elastic band member 2*v* and the hem of the sports spats may be a single elastic band member; however, tension can be applied more easily by forming two elastic band members so that the below-the-knee elastic band member 2*v* is pulled downward to the left and right. It would also be possible to have only the front thigh elastic band member 2*a* and back thigh elastic band member 2*c* formed without forming the below-the-knee elastic band member 2*v*.

Figure 13:
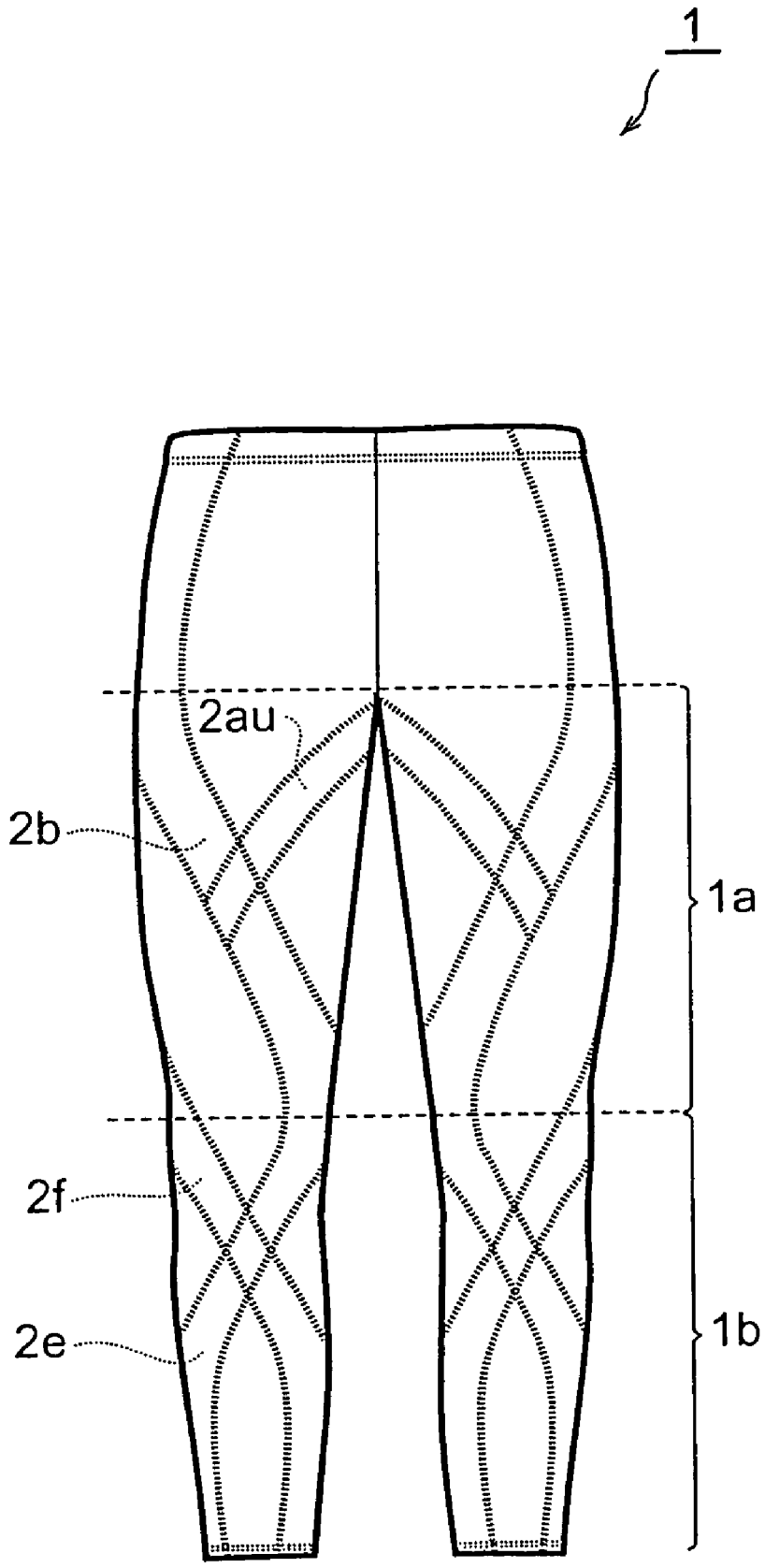
FIG. 13 is a diagram of sports spats as seen from the front surface.

Next, an example of the deformation of the elastic band members on the front side of the thigh will be described with reference to the front views of sports spats shown in FIGS. 13 through 16. FIG. 13 shows a state in which the front thigh elastic band member 2*b* and a front thigh elastic band member 2*au* (thigh upper part elastic band member) are combined on the front side of the thigh. As was described above, the front thigh elastic band member 2*b* is formed obliquely from the upper part to the lower part of the front surface of the thigh. The front thigh elastic band member 2*au* is formed from the upper part of the inside of the thigh to a connecting portion of the two elastic band members 2*b* and 2*au* which is located at an intermediate point on the front thigh elastic band member 2*b*. As a result of the installation of such a front thigh elastic band member 2*au*, tension can be applied to the front thigh elastic band member 2*b* that is formed obliquely from the upper part to the lower part of the front side of the thigh, so that the supporting effect provided by the front thigh elastic band member 2*b* can be improved. Furthermore, the width of the front thigh elastic band member 2*au* can be made narrower than the width of the front thigh elastic band member 2*b*. In concrete terms, this may be a width of approximately 2 to 4 cm.

Figure 14:
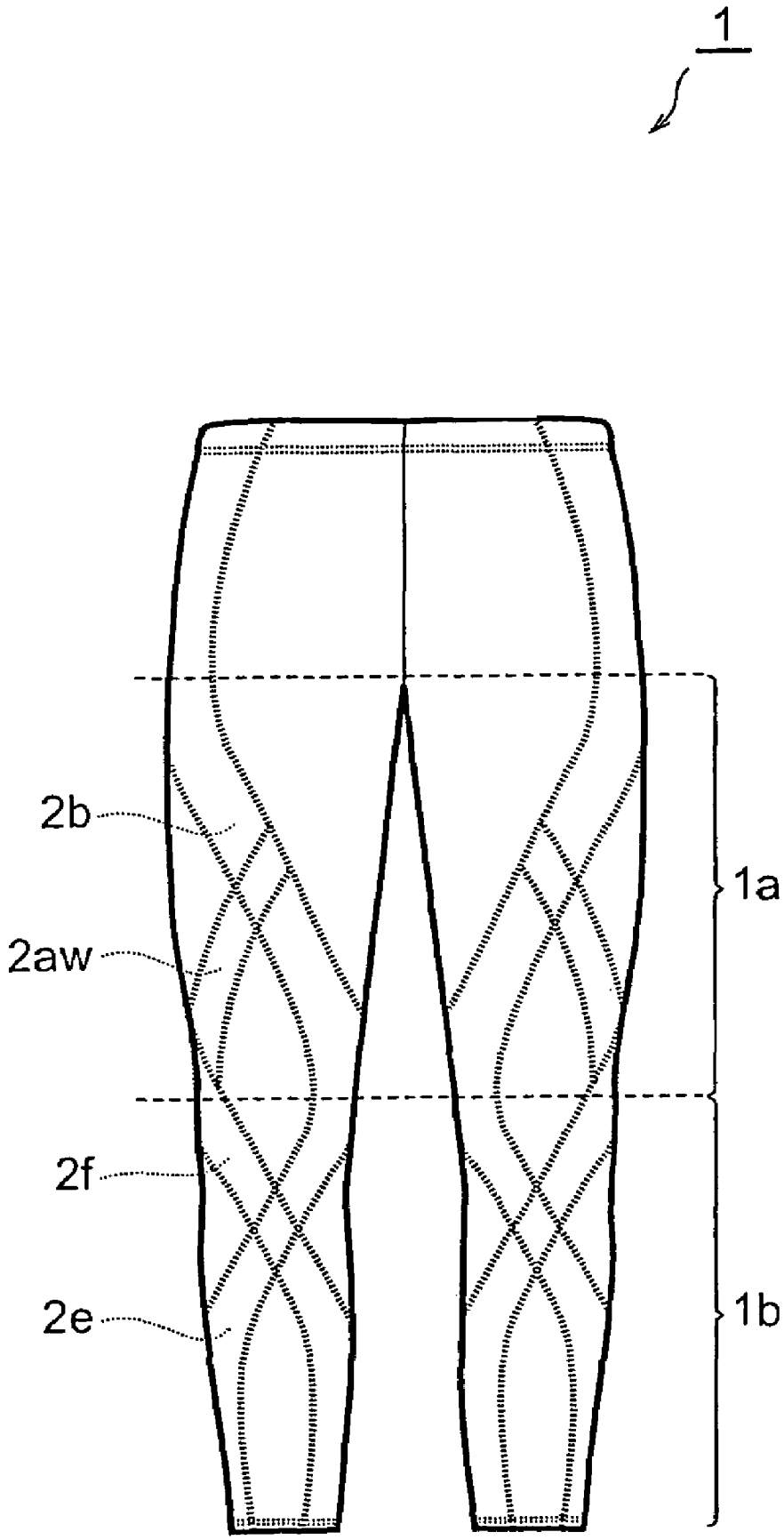
FIG. 14 is a diagram of sports spats as seen from the front surface.

FIG. 14 shows a state in which the front thigh elastic band member 2*b* and a front thigh elastic band member 2*aw* (thigh lower part elastic band member) are combined on the front side of the thigh. The front thigh elastic band member 2*aw* is formed from the lower part of the outside of the thigh to a connecting portion of the two elastic band members 2*b* and 2*aw* which is located at an intermediate point on the front thigh elastic band member 2*b*. Furthermore, the lower part of the front thigh elastic band member 2*aw* is connected to the upper part of the front crus elastic band member 2*f* which is formed on the outside of the knee. As a result of the provision of such a front thigh elastic band member 2*aw*, tension can be applied to the front thigh elastic band member 2*b* which is formed obliquely from the upper part to the lower part of the front side of the thigh, so that the supporting effect provided by the front thigh elastic band member 2*b* can be improved. Furthermore, since tension can also be applied to the front crus elastic band member 2*f* formed on the outside of the knee, the effect that supports the knee can be improved. Moreover, the width of the thigh front side supporting part 2*aw* can be made narrower than the width of the front thigh elastic band member 2*b* and front crus elastic band member 2*f*. In concrete terms, this width may be approximately 2 to 4 cm. Furthermore, in cases where the front thigh elastic band member 2*b* has a curved shape that is curved in an indented shape toward the lower part of the thigh on the front side of the thigh, and the front thigh elastic band member 2*aw* is connected to the front thigh elastic band member 2*b* at a point immediately above the knee joint, an above-the-knee elastic band member is formed by this front thigh elastic band member 2*b* and front thigh elastic band member 2*aw*. Specifically, this above-the-knee elastic band member is formed from a portion corresponding to the inside of the knee joint and a portion corresponding to the outside of the knee joint to a portion corresponding to the upper side of the knee joint. The lower edge of the above-the-knee elastic band member is formed in an inverted V shape. Furthermore, the shape of the lower edge of the above-the-knee elastic band member need not always be an inverted V shape; for example, this edge may also be formed in an inverted U shape or crescent shape. Specifically, it is sufficient if the shape of the lower edge of the above-the-knee elastic band member is formed in a shape that is indented toward the upper part of the thigh. As a result of the formation of such an above-the-knee elastic band member, the stability of the knee can be improved.

Figure 15:
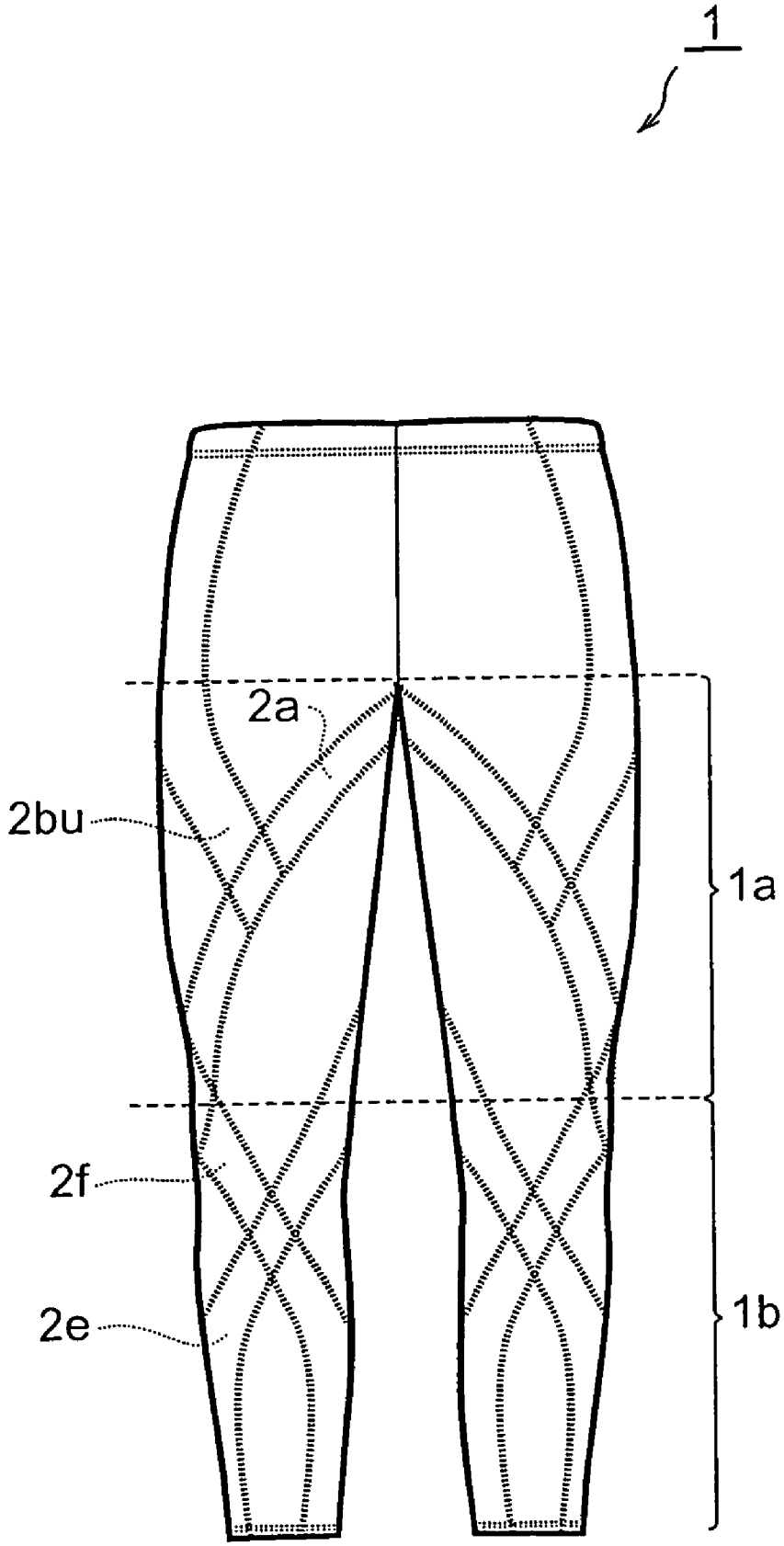
FIG. 15 is a diagram of sports spats as seen from the front surface.

FIG. 15 shows a state in which the front thigh elastic band member 2*a* and a front thigh elastic band member 2*bu* (thigh upper part elastic band member) are combined on the front side of the thigh. As was described above, the front thigh elastic band member 2*a* is formed obliquely from the upper part to the lower part of the front surface of the thigh. The front thigh elastic band member 2*bu* is formed from the upper part of the outside of the thigh to a connecting portion of the two elastic band members 2*a* and 2*bu* located at an intermediate point on the front thigh elastic band member 2*a*. As a result of the provision of such a front thigh elastic band member 2*bw*, tension can be applied to the front thigh elastic band member 2*a* that is formed obliquely from the upper part to the lower part of the front side of the thigh, so that the supporting effect provided by the front thigh elastic band member 2*a* can be improved. Furthermore, the width of the front thigh elastic band member 2*bu* can be made narrower than the width of the front thigh elastic band member 2*a*. In concrete terms, this width may be approximately 2 to 4 cm.

Figure 16:
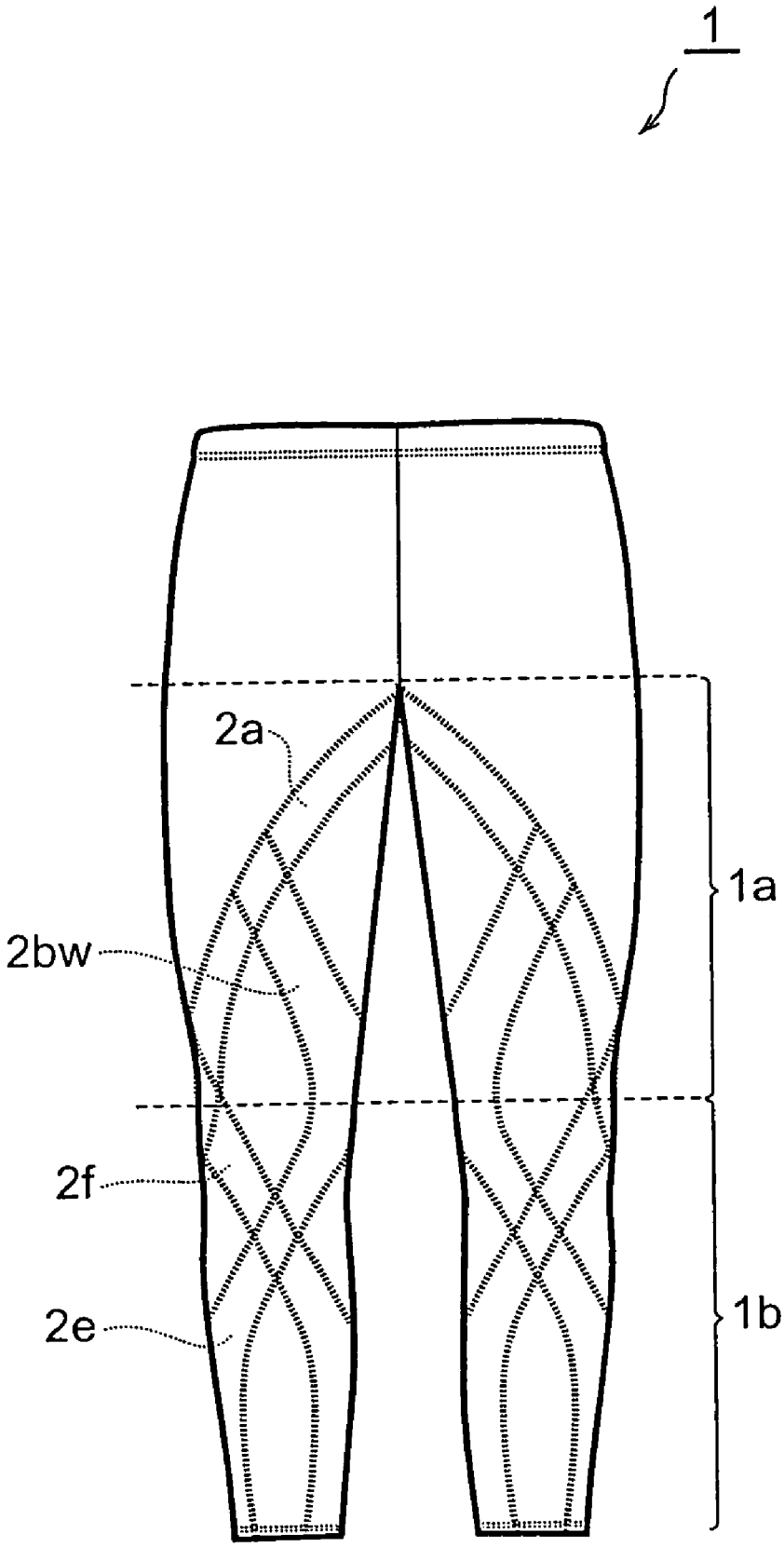
FIG. 16 is a diagram of sports spats as seen from the front surface.

FIG. 16 shows a state in which the front thigh elastic band member 2*a* and a front thigh elastic band member 2*bw* (thigh lower part elastic band member) are combined on the front side of the thigh. The front thigh elastic band member 2*bw* is formed from the lower part of the thigh to a connecting portion of the two elastic band members 2*a* and 2*bw* which is located at an intermediate point on the front thigh elastic band member 2*a*. Furthermore, the lower part of the front thigh elastic band member 2*bw* is connected to the upper part of the front crus elastic band member 2*e* formed on the inside of the knee. As a result of the provision of such a front thigh elastic band member 2*bw*, tension can be applied to the front thigh elastic band member 2*a* which is formed obliquely from the upper part to the lower part of the front side of the thigh, so that the supporting effect provided by the front thigh elastic band member 2*a* can be improved. Furthermore, since tension can also be applied to the front crus elastic band member 2*e* formed on the outside of the knee, the effect that supports the knee can be improved. Moreover, the width of the front thigh elastic band member 2*bw* can be made narrower than the width of the front thigh elastic band member 2*a* and front crus elastic band member 2*e*. In concrete terms, this width may be approximately 2 to 4 cm. Furthermore, in cases where the front thigh elastic band member 2*a* has a curved shape that is curved in an indented shape toward the lower part of the thigh on the front side of the thigh, and the front thigh elastic band member 2*bw* is connected to the front thigh elastic band member 2*a* at a point immediately above the knee joint, an above-the-knee elastic band member is formed by this front thigh elastic band member 2*a* and front thigh elastic band member 2*bw*. Specifically, this above-the-knee elastic band member is formed from a portion corresponding to the inside of the knee joint and a portion corresponding to the outside of the knee joint to a portion corresponding to the upper side of the knee joint. The lower edge of the above-the-knee elastic band member is formed in an inverted V shape. Furthermore, the shape of the lower edge of the above-the-knee elastic band member need not always be an inverted V shape; for example, this edge may also be formed in an inverted U shape or crescent shape. Specifically, it is sufficient if the shape of the lower edge of the above-the-knee elastic band member is formed in a shape that is indented toward the upper part of the thigh.

As is shown in FIGS. 13 through 16, it is desirable that elastic band members 2*au*, 2*aw*, 2*bu* and 2*bw* which have an inclination that allows intersection with the front thigh elastic band member formed obliquely from the upper part to the lower part of the front surface of the thigh, and which are formed from the upper side part or lower side part of the thigh to an intermediate point on the front thigh elastic band member, be disposed on the front side of the thigh. Furthermore, it is desirable that these elastic band members 2*au*, 2*aw*, 2*bu* and 2*bw* be connected to the upper part of the front crus elastic band member formed on the outside or inside of the knee. Moreover, it is desirable that the connecting portions with the other front thigh elastic band members 2*au*, 2*aw*, 2*bu* and 2*bw* formed at intermediate points of the front thigh elastic band members 2*a* and 2*b* be formed in the vicinity of the center in the longitudinal direction of the front thigh elastic band members 2*a* and 2*b* on the thigh. As a result, mutual tension can be applied more easily to the respective elastic band members.

Furthermore, the elastic band members 2*au*, 2*aw*, 2*bu* and 2*bw* shown in the FIGS. 13 through 16 show as an example a case in which these elastic band members are disposed on the front side of the thigh. However, it would also be possible to dispose similar elastic band members on the rear side of the thigh. Specifically, elastic band members which have an inclination that allows intersection with the back thigh elastic band member formed obliquely from the upper part to the lower part of the rear surface of the thigh, and which are formed from the upper side part or lower side part of the thigh to an intermediate point on the back thigh elastic band member, may be disposed on the rear side of the thigh. Furthermore, these elastic band members may be connected to the upper part of the back crus elastic band member formed on the outside or inside of the knee.

Furthermore, the above-the-knee elastic band member shown in FIGS. 14 and 16 may also be formed in combination with the front crus elastic band member 2*e* and back crus elastic band member 2*g*. In this case, the above-the-knee elastic band member connects with the front crus elastic band member 2*e* or back crus elastic band member 2*g* in a portion corresponding to the inside or outside of the knee. Furthermore, the front crus elastic band member 2*e* and back crus elastic band member 2*g* are formed so that these elastic band members incline in respectively opposite directions with respect to the vertical direction in the crus as seen from either the front side or the rear side of the crus. Specifically, the front crus elastic band member 2*e* is formed so that this elastic band member extends from the inner knee, contacts the front side of the crus, and extends to the outer ankle on the lower part of the crus. Meanwhile, the back crus elastic band member 2*g* is formed so that this elastic band member extends from the outer knee, contacts the rear side of the crus, and extends to the inner ankle on the lower part of the crus. Furthermore, the above-the-knee elastic band member shown in FIGS. 14 and 16 may also be formed by combining the front crus elastic band member 2*f* and back crus elastic band member 2*h*. In this case, the above-the-knee elastic band member connects with the front crus elastic band member 2*f* or back crus elastic band member 2*h* in a portion corresponding to the inside or outside of the knee. Furthermore, the front crus elastic band member 2*f* and back crus elastic band member 2*h* are formed so that these elastic band members respectively incline in opposite directions with respect to the vertical direction in the crus as seen from either the front side or rear side of the crus. Specifically, the front crus elastic band member 2*f* is formed so that this elastic band member extends from the outer knee, contacts the front side of the crus, and extends to the inner ankle on the lower part of the crus. On the other hand, the back crus elastic band member 2*h* is formed so that this elastic band member extends from the inner knee, contacts the rear side of the crus, and extends to the outer ankle on the lower part of the crus. As a result of strong elastic band members thus being formed with mutually opposite inclinations on the front and back of the crus, and thus being connected with the above-the-knee elastic band member, tension is applied to respective elastic band members contacting the area above the knee, the inside of the knee and the outside of the knee, so that the knee can be supported. In this case, furthermore, if no elastic band member is installed below the knee, the degree of freedom of the knee can be ensured. On the other hand, in cases where a elastic band member is disposed below the knee, the stability of the knee can be improved.

Furthermore, the above-the-knee elastic band member shown in FIGS. 14 and 16 and the below-the-knee elastic band member 2*v* shown in FIG. 8 may be combined. As a result, the periphery of the knee is firmly supported. In this case, it is desirable that a elastic band member be formed from the upper part of the above-the-knee elastic band member to a portion that corresponds to at least either the inside or outside of the thigh, and that a elastic band member be formed from the lower part of the below-the-knee elastic band member to a portion that corresponds to at least either the inside or outside of the ankle. Furthermore, it is desirable that these elastic band members be formed from the upper part of the above-the-knee elastic band member to the upper parts of the inside and outside of the thigh, and from the lower part of the below-the-knee elastic band member to the lower parts of the inside and outside of the ankle (to the hem in the case of ankle length). A front thigh elastic band member and front crus elastic band member are formed by these elastic band members. Meanwhile, it is desirable that the back thigh elastic band member formed on the rear side of the thigh be inclined in the opposite direction form the front thigh elastic band member when seen from either the front side or the rear side of the spats 1. Furthermore, it is desirable that the back crus elastic band member formed on the rear side of the crus be inclined in the opposite direction from the front crus elastic band member when seen from either the front side or the rear side of the spats 1. As a result of the front and rear elastic band members thus being formed with opposite inclinations, the thigh, knee and calf are supported with a better balance.

In this manner, when the thigh is supported from front and behind with the front thigh elastic band member and back thigh elastic band member, and the crus is supported from front and behind with the front crus elastic band member and the crus rear side elastic band member, the hip joint, the knee joint, and ankle can pivot inwardly and outwardly and rotate inwardly and outwardly further easily. As the knee is supported from the left and right by part of each elastic band member, the knee joint can bend and stretch easily.

The relationship in inclination among the respective elastic band members between the front side of the thigh and the front side of the crus, or between the rear side of the thigh and the rear side of the crus is preferably set such that the inclinations of the elastic band members of the thigh and the inclinations of the elastic band members of the crus are opposite to each other. Then, in the entire leg including the thigh and calf, muscles necessary for the inner and outer pivoting motion and the inner and outer rotating motion can be supported with a better balance.

Regarding the elastic band members formed on the thigh and crus, it suffices as far as the elastic band members formed on one of the thigh and crus are formed to clamp the thigh or crus from front and behind. In this case, the elastic band members formed on the other may be formed to clamp the crus or thigh from the left and right. This will be described in detail. For example, on the thigh, it suffices as far as elastic band members are formed to clamp the thigh from front and behind and are in contact with the inner and outer sides of the knee, while on the crus, it suffices as far as elastic band members are formed to clamp the crus from the left and right and to reach the hem. Alternatively, on the thigh, elastic band members may be formed to clamp the thigh from the left and right and are in contact with the inner and outer sides of the knee, while on the crus, elastic band members may be formed to clamp the crus from front and behind and to reach the hem. When the elastic band members are formed in this manner, the thigh or crus is firmly supported from front and behind, and the knee is firmly supported from the left and right. Hence, muscles necessary for respective movements in the inner and outer pivoting motion, inner and outer rotating motion, and bending and stretching motion can be supported with a good balance.

Furthermore, in cases where the thigh is supported from the front and back by a front thigh elastic band member and a back thigh elastic band member, it is sufficient if the garment has at least one of the elastic band members, i.e., either a front crus elastic band member or a crus rear side elastic band member.

Furthermore, in cases where the thigh is supported from the front and back by a front thigh elastic band member and a back thigh elastic band member, the front thigh elastic band member and back thigh elastic band member may be respectively formed in substantially the same position in a portion corresponding to the front side or rear side of the thigh as seen from the front side or rear side of the thigh, or the front thigh elastic band member and back thigh elastic band member may be formed so that these elastic band members are shifted in the vertical direction. For example, there is a case wherein the front thigh elastic band member is formed above a portion corresponding to the front side of the thigh, and the back thigh elastic band member is formed below a portion corresponding to the rear side of the thigh. Also, there is a case wherein the front thigh elastic band member is formed below a portion corresponding to the front side of the thigh, and the back thigh elastic band member is formed above a portion corresponding to the rear side of the thigh.

Furthermore, in cases where the crus is supported from the front and back by a front crus elastic band member and a crus rear side elastic band member, the front crus elastic band member and back crus elastic band member may be respectively formed in substantially the same position in a portion corresponding to the front side or rear side of the crus as seen from the front side or rear side of the crus, or the front crus elastic band member and back crus elastic band member may be formed so that these elastic band members are shifted in the vertical direction. For example, there is a case wherein the front crus elastic band member is formed above a portion corresponding to the front side of the crus, and the back crus elastic band member is formed below a portion corresponding to the rear side of the crus. Also, there is a case wherein the front crus elastic band member is formed below a portion corresponding to the front side of the crus, and the back crus elastic band member is formed above a portion corresponding to the rear side of the crus.

Furthermore, in the present embodiment, the elastic band member 2 was described as being divided into a thigh portion and a crus portion; however, this division was made for convenience of description, and does not indicate that the elastic band member 2 is split into a thigh portion and crus portion.

The embodiment described above exemplifies cases wherein present invention is applied to ankle length sports spats which cover the hips to crus. The present invention can also be applied to above knee length sports spats which cover the hips to thighs, and below knee length sports spats which cover from the hips to below knee portions. The present invention can also be applied to sports spats having a portion for covering the upper half of the body above the waist, or sports spats or tights having a portion extending downward from the ankle across the sole of the foot. Furthermore, these sport spats may be sports spats that have a protective pad in the crotch area.

Figure 17B:
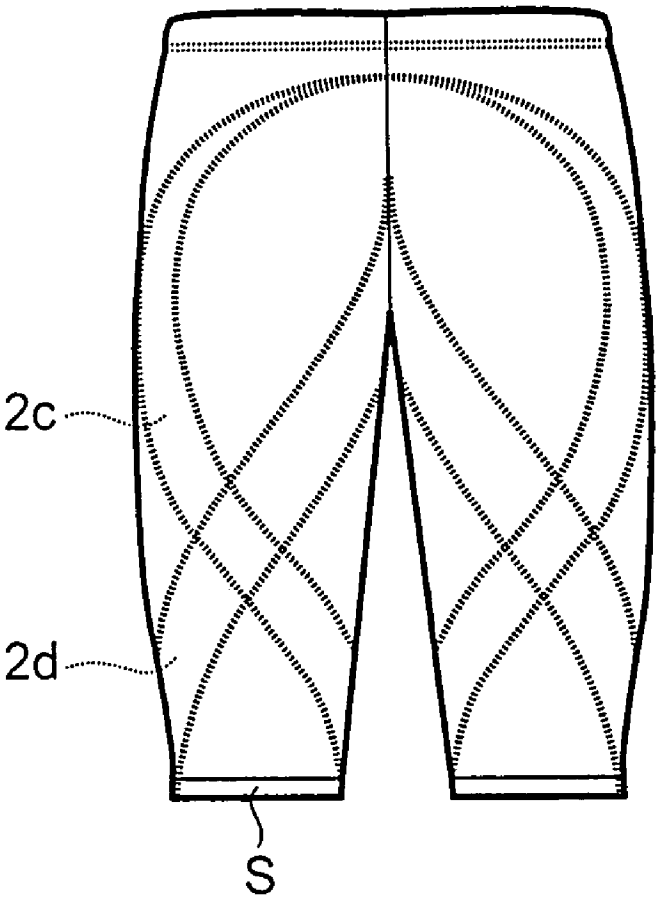
FIG. 17B is a diagram of these above-knee length sports spats as seen from the back surface.
Figure 17A:
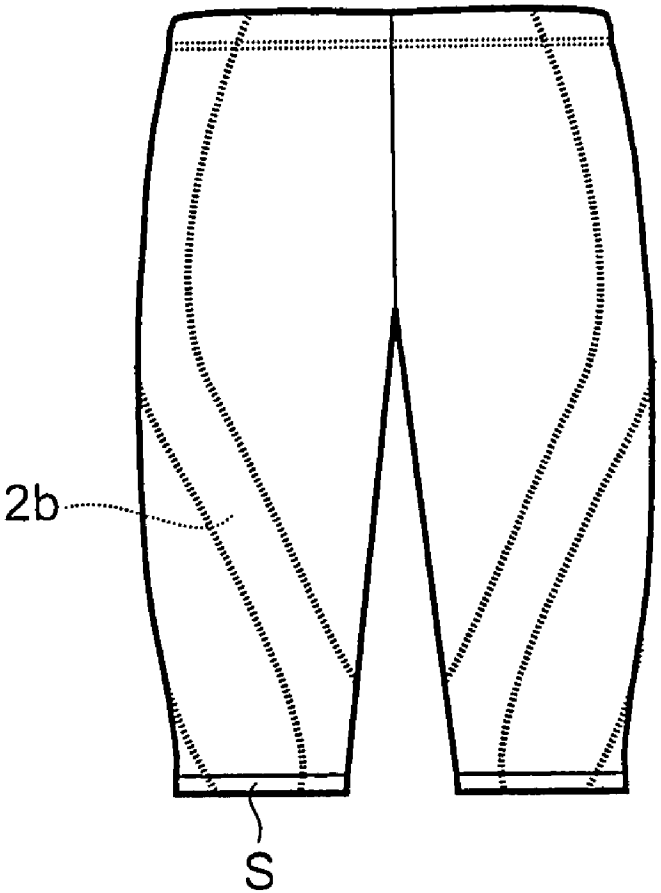
FIG. 17A is a diagram of above-knee length sports spats as seen from the front surface.

A practical example of the above knee length sports spats will be described with reference to FIGS. 17 to 21. FIG. 17A is a front view of the above knee length sports spats and shows a state wherein the front thigh elastic band member 2*b* described above is formed on the front side of the thigh. FIG. 17B is a rear view of the above knee length sports spats and shows a state wherein the back thigh elastic band member 2*c* and back thigh elastic band member 2*d* described above are formed on the rear side of the thigh. In the spats shown in FIGS. 17A and 17B, on the thigh, the front thigh elastic band member 2*b* and back thigh elastic band member 2*c* are formed to incline in the same direction, and the front thigh elastic band member 2*b* an back thigh elastic band member 2*d* are formed to incline in opposite directions. The front thigh elastic band member 2*b* contacts the side part of the pelvic region including the greater trochanter 113, and is formed in a portion that extends in the upper direction along the side part of the pelvic region and reaches the waist. The back thigh elastic band member 2*c* connects with the front thigh elastic band member 2*b* at the side part of the pelvic region, and further contacts the upper part of the pelvic region as well; the left and right back thigh elastic band members are connected at the rear center of the upper part of the pelvic region. As a result of such a connection, tension is mutually applied to the back thigh elastic band member 2*c* and front thigh elastic band member 2*b*, so that the effect that supports the muscles of the thigh is increased, and so that the knee joint is supported. Furthermore, the upper ends of the back thigh elastic band members 2*d* located on the left and right thighs are connected in the vicinity of the connecting point of the hip bones (lower part of the natal cleft). As a result, tension is mutually applied to the back thigh elastic band members 2*d* located on the left and right thighs. Furthermore, the upper part of back thigh elastic band member 2*d* may be positioned on the inside upper part of the rear side of the thigh (below the crotch). Furthermore, the lower end of front thigh elastic band member 2*b* and the lower end of back thigh elastic band member 2*c* are positioned at the hem part S on the inside of the thigh, and the lower end of back thigh elastic band member 2*d* is positioned at the hem part S on the outside of the thigh. The lower end of this front thigh elastic band member 2*b* and the lower end of the back thigh elastic band member 2*c* are connected on the inside of the thigh. It is desirable that the vertical width of this connection area be approximately 5 to 10 cm. When the respective elastic band members are formed in this manner, the wearer's thigh is firmly supported from front and behind. Of the lower end of a front thigh elastic band member 2*a*, the lower end of the back thigh elastic band member 2*c*, and the lower end of the back thigh elastic band member 2*d*, all the lower ends need not be located at the hem S of the sports spats, but it suffices as far as at least either one lower end is located at the hem S. Also, the lower end position of the elastic band member 2 as described above applies to the above-the-knee sports spats, shown in FIG. 18 through FIG. 21 described below, as well.

Figure 18B:
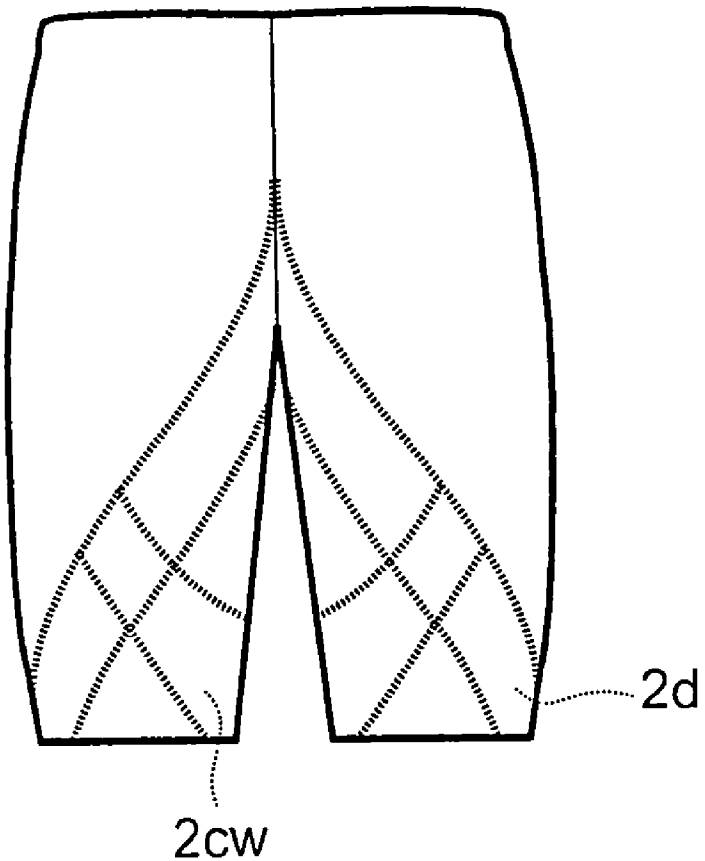
FIG. 18B is a diagram of these above-knee length sports spats as seen from the back surface.

FIG. 18(*a*) is a diagram showing above-knee length sports spats as seen from the front surface. This diagram shows a state in which the front thigh elastic band member 2*b* is formed on the front side of [each] thigh, and abdomen elastic band members 2*x* are formed on the abdomen. FIG. 18(*b*) is a diagram which shows these above-knee length sports spats as from the back surface. This diagram shows a state in which a back thigh elastic band member 2*cw* which is the lower part of the back thigh elastic band member 2*c*, and a back thigh elastic band member 2*d*, are formed on the rear side of [each] thigh. The abdomen elastic band members 2*x* shown in FIG. 18(*a*) connects with the front thigh elastic band members 2*b* at the side parts of the pelvic region. The abdomen elastic band members 2*x* located on the left and right connect with each other at the center of the abdomen. As a result, the front thigh elastic band members 2*b* that contact both side parts of the pelvic region can be pulled toward the center of the body, so that the hip joints can be stabilized. Specifically, as a result of the formation of the abdomen elastic band members 2*x*, a force that pulls both side parts of the pelvic region toward the inside can be applied, so that the pelvis can be stabilized. It is desirable that the abdomen tighten portions 2*x* be formed so that these portions contact an area above the lower abdomen. As a result, pressure on the lower abdomen near the crotch can be prevented. Furthermore, the material of the abdomen elastic band members 2*x* may be a separate material that has a weaker tightening force than the material of the front thigh elastic band members 2*b*, or may be the same material as that of the front thigh elastic band members 2*b*. The abdomen elastic band members 2*x* and front thigh elastic band members 2*b* may be continuous, and may be constructed from the same material. Furthermore, it is desirable that the width of the abdomen elastic band members 2*x* is 2 cm or greater, and a width of approximately 5 to 15 cm is desirable. The width of the abdomen elastic band members 2*x* may be a uniform width; alternatively, the width of the abdomen elastic band members 2*x* may narrow toward the center of the body from the side parts of the pelvic region, or may increase toward the center of the body from the side parts of the pelvic region. Furthermore, the abdomen elastic band members 2*x* may be sewed to the inside of the main body cloth, or may be sewed to the outside of the main body cloth. The connecting portions between the abdomen elastic band members 2*x* and the front thigh elastic band members 2*b* are sewed to the main body cloth; however, the upper edges and lower edges of the abdomen elastic band members 2*x* may be in a floating state without being sewed to the main body cloth. Furthermore, the back thigh elastic band members 2*cw* shown in FIG. 18(*b*) connect with parts of the back thigh elastic band members 2*d* located near the center of the rear side of each thigh, and are formed only on the lower inside of each thigh. Furthermore, back thigh elastic band members 2*cw* and front thigh elastic band members 2*b* may be connected on the lower inside of each thigh.

Figure 19B:
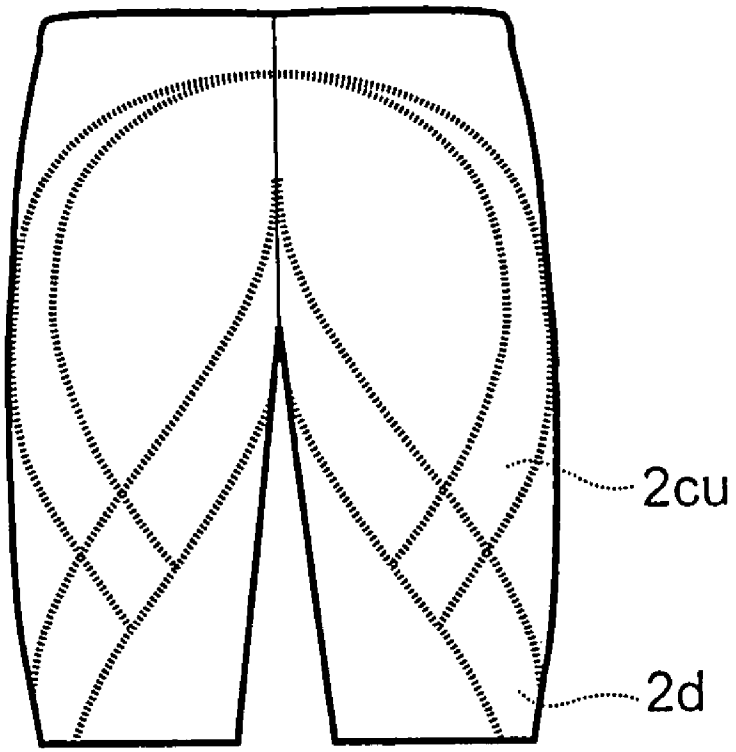
FIG. 19B is a diagram of these above-knee length sports spats as seen from the back surface.

FIG. 19(*a*) is a diagram showing above-knee length sports spats as seen from the front surface. This diagram shows a state in which the front thigh elastic band members 2*b* are formed on the front side of each thigh, and abdomen elastic band members 2*y* are formed on the abdomen. FIG. 19(*b*) is a diagram which shows these above-knee length sports spats as seen from the back surface; this diagram shows a state in which back thigh elastic band members 2*cu* which are the upper portions of the back thigh elastic band members 2*c*, and back thigh elastic band members 2*d*, are formed on the rear side of each thigh. The abdomen elastic band members 2*y* shown in FIG. 19(*a*) are connected with the front thigh elastic band members 2*b* at the side parts of the pelvic region. These abdomen elastic band members 2*y* are formed so as to contact the upper abdomen. As a result, the front thigh elastic band members 2*b* contacting both side parts of the pelvic region can be pulled toward the center of the body, so that the hip joints can be stabilized. Specifically, as a result of the formation of the abdomen elastic band members 2*y*, both side parts of the pelvic region can be pulled toward the inside, so that the pelvis can be stabilized. The abdomen elastic band members 2*y* have a maximum width in the connecting portions with the front thigh elastic band members 2*b*, and these elastic band members extend to a point beyond the front center of the body with the width of the elastic band members gradually decreasing toward the front center of the body. Accordingly, the abdomen elastic band members 2*y* located on the left and right overlap in the portions that extend beyond the front center of the body. Furthermore, it is desirable that the width of the widest portions be approximately 10 cm. Moreover, the material of the abdomen elastic band members 2*y* may be a separate material from that of the front thigh elastic band members 2*b*, or may be the same material as that of the front thigh elastic band members 2*b*. The abdomen elastic band members 2*y* and front thigh elastic band members 2*b* may be continuous, and may be constructed from the same material. Furthermore, the connecting portions between the abdomen elastic band members 2*y* and front thigh elastic band members 2*b* are sewed to the main body cloth; however, either the upper edges or the lower edges of the abdomen elastic band members 2*y* may be in a floating state without being sewed to the main body cloth. Furthermore, the back thigh elastic band members 2*cu* shown in FIG. 19(*b*) connect with parts of the back thigh elastic band members 2*d* located near the center of the rear side of each thigh, and contact the upper outside of each thigh; these connect with the front thigh elastic band members in the vicinity of the greater trochanter, and are formed on the upper part of the pelvic region.

Figure 20B:
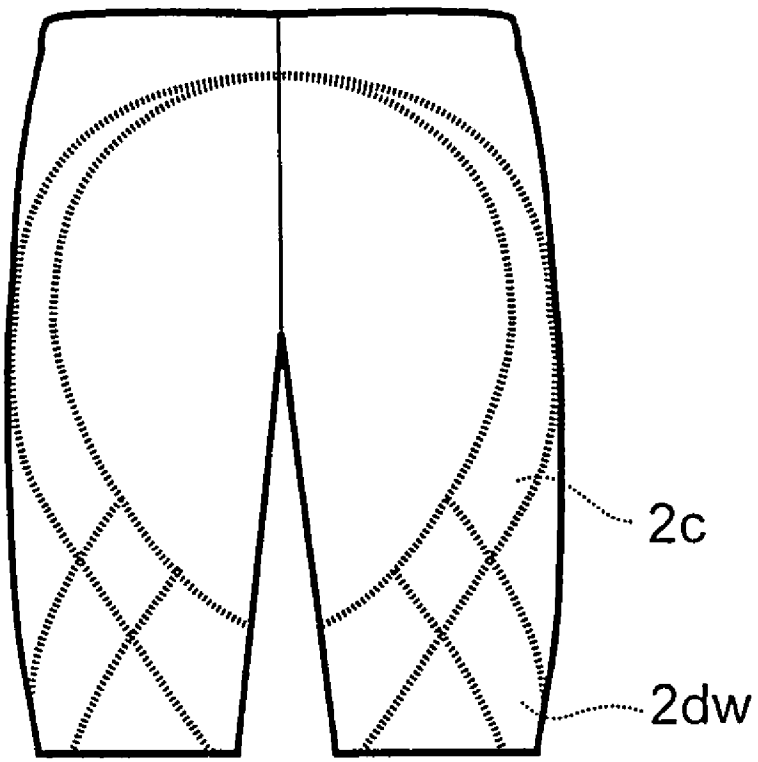
FIG. 20B is a diagram of these above-knee length sports spats as seen from the back surface.

FIG. 20(*a*) is a diagram showing above-knee length sports spats as seen from the front surface; this diagram shows a state in which the front thigh elastic band members 2*b* are formed on the front side of each thigh, and abdomen elastic band members 2*z* are formed on the abdomen. FIG. 20(*b*) is a diagram which shows these above-knee length sports spats as seen from the back surface; this diagram shows a state in which the back thigh elastic band members 2*c*, and back thigh elastic band members 2*dw* which are the lower parts of the back thigh elastic band members 2*d*, are formed on the rear side of each thigh. The abdomen elastic band members 2*z* shown in FIG. 20(*a*) are formed by a material that is continuous with the front thigh elastic band members 2*b*. Furthermore, the material of the abdomen elastic band members 2*z* may also be a separate material from that of the front thigh elastic band members 2*b*. The abdomen elastic band members 2*z* have a maximum width in the portions that are continuous with the front thigh elastic band members 2*b*, and this width gradually decreases toward the front center of the body. Furthermore, it is desirable that the width of the widest portion be approximately 10 cm, and it is desirable that the width of the narrowest portion be approximately 5 cm. Furthermore, the abdomen elastic band members 2*z* located on the left and right are connected to each other at the front center of the body. As a result, the front thigh elastic band members 2*b* contacting both side parts of the pelvic region can be pulled toward the center of the body, so that the hip joints can be stabilized. Specifically, as a result of the formation of the abdomen elastic band members 2*z*, a force that pulls both side parts of the pelvic region toward the inside can be applied, so that the pelvis can be stabilized. Furthermore, either the upper edges or the lower edges of the abdomen elastic band members 2*z* may be in a floating state without being sewed to the main body cloth. Furthermore, the back thigh elastic band members 2*dw* shown in FIG. 20(*b*) connect with parts of the back thigh elastic band members 2*c* located near the center of the rear side of each thigh, and are formed only on the lower outside of each thigh. Moreover, front thigh elastic band members 2*b* and back thigh elastic band members 2*c* are connected in the vicinity of the greater trochanter on the lower inside of each thigh and upper outside of each thigh. Furthermore, the three types of the abdomen elastic band members 2*x*, 2*y* and 2*z* described above may be appropriately combined with various elastic band members described in the other embodiments (ankle length sports spats) described above.

Figure 18A:
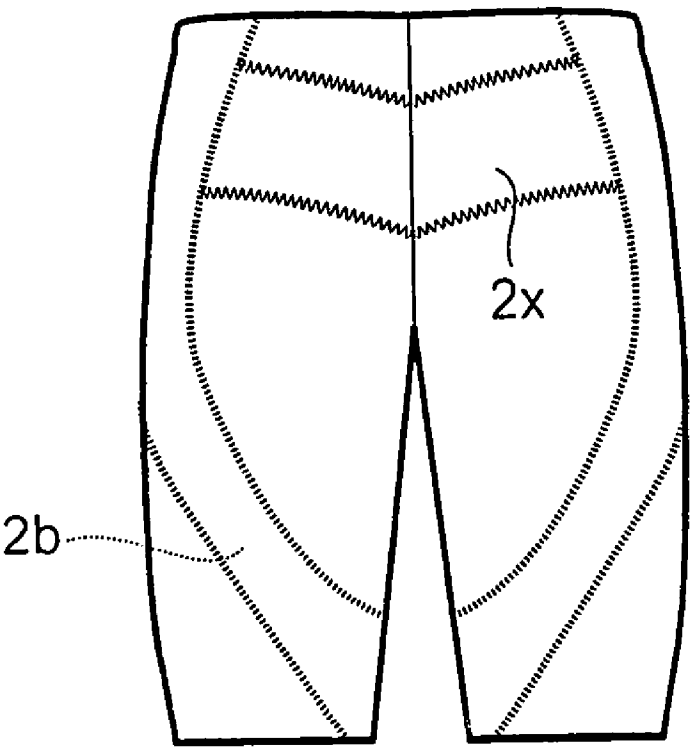
FIG. 18A is a diagram of above-knee length sports spats as seen from the front surface.
Figure 19A:
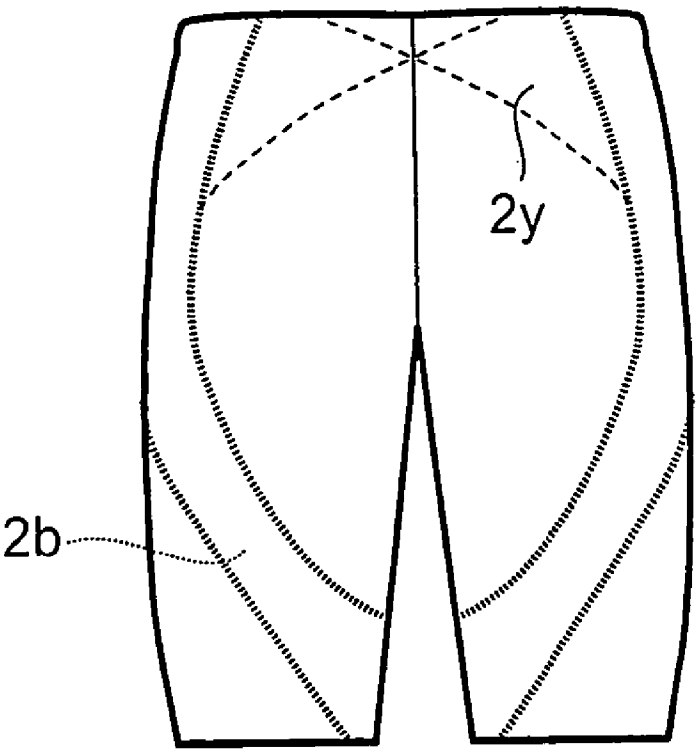
FIG. 19A is a diagram of above-knee length sports spats as seen from the front surface.
Figure 20A:
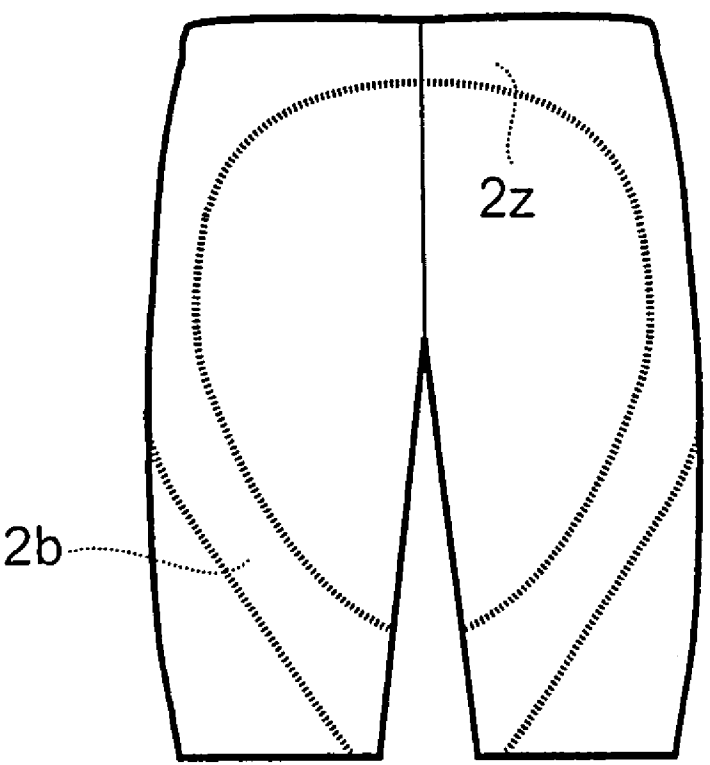
FIG. 20A is a diagram of above-knee length sports spats as seen from the front surface.

Furthermore, the abdomen elastic band members 2*x*, 2*y* and 2*z* shown in FIGS. 18A, 19A and 20A connect the front thigh elastic band members 2*b* formed in portions corresponding to the left and right side parts of the pelvic region; however, the elastic band members connected by the abdomen elastic band members 2*x*, 2*y* and 2*z* are not limited to the front thigh elastic band members 2*b*. For example, these elastic band members may also be back thigh elastic band members, or other elastic band members formed in portions corresponding to both the left and right side parts of the pelvic region. Specifically, in the description relating to the FIGS. 18 through 20, the front thigh elastic band members 2*b* were used for convenience of description as the elastic band members connected by the abdomen elastic band members 2*x*, 2*y* and 2*z*; however, the elastic band members connected by the abdomen elastic band members 2*x*, 2*y* and 2*z* may be pelvic region elastic band members formed in portions corresponding to the left and right side parts of the pelvic region. By having the abdomen elastic band members 2*x*, 2*y* and 2*z* connected to the sections of the hip elastic band member corresponding to the left and right sides of the hip, tension can be applied to the hip elastic band member. Also, this type of abdomen elastic band member and hip elastic band member can be combined with the various band members formed at the thigh, the knee, and the lower thigh in the embodiments described above.

Figure 21B:
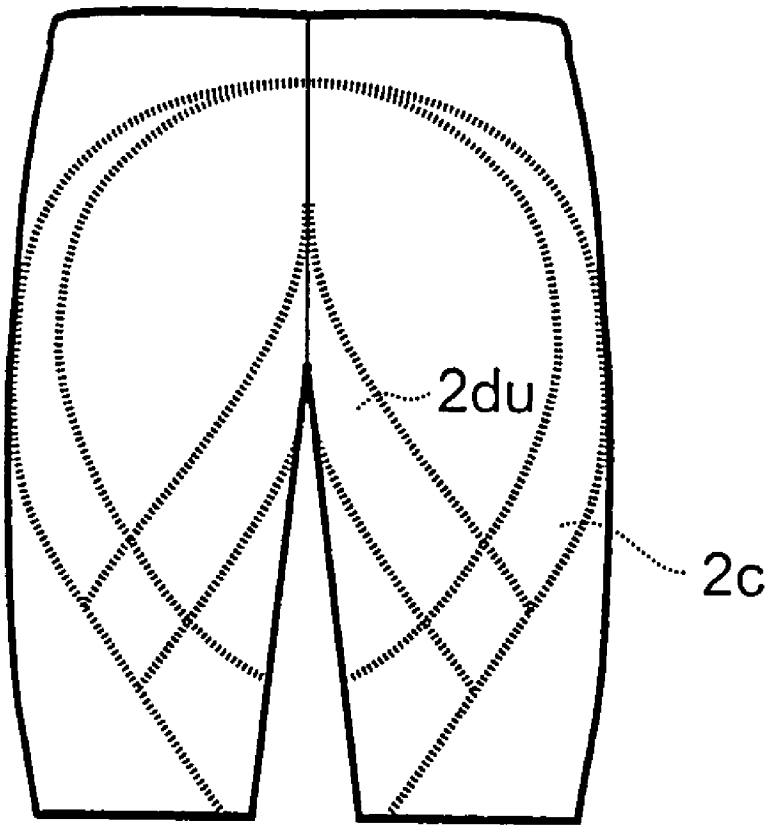
FIG. 21B is a diagram of these above-knee length sports spats as seen from the back surface.
Figure 21A:
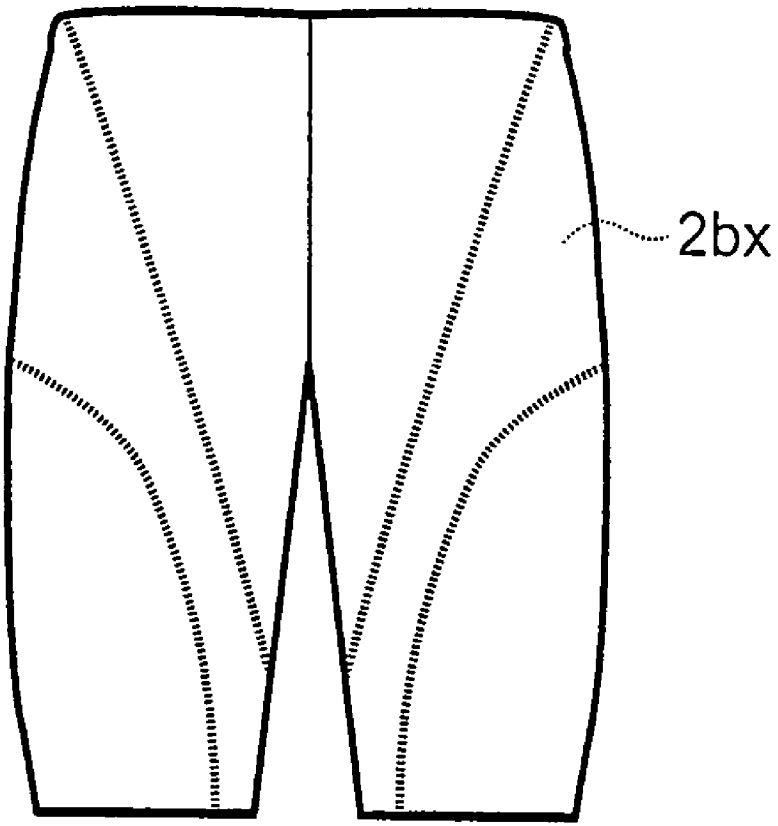
FIG. 21A is a diagram of above-knee length sports spats as seen from the front surface.

FIG. 21A is a diagram of above-knee length sports spats as seen from the front surface; this diagram shows a state in which front thigh elastic band member 2*bx* that are modifications of the front thigh elastic band members 2*b* are formed on the front side of each thigh. FIG. 21B is a diagram of these above-knee length sports spats as seen from the back surface; this diagram shows a state in which the back thigh elastic band members 2*c*, and back thigh elastic band members 2*du* that are the upper portions of the back thigh elastic band members 2*d*, are formed on the rear side of each thigh. The front thigh elastic band members 2*bx* shown in FIG. 21A are formed by curving the line of the front thigh elastic band members 2*b* in an indented shape toward the upper part on the front surface of each thigh. The front thigh elastic band members 2*bx* are formed so that these elastic band members contact portions that extend from the vicinity of the greater trochanter 113, pass over the upper portion of the front surface of the thigh, and reach the lower inside of the thigh. Specifically, the front thigh elastic band members 2*bx* reach the greater trochanter without passing over the bulge of the rectus femoris. Accordingly, compared to a case in which the front thigh elastic band members 2*bx* are formed with a rectilinear shape, an effect that prevents pressure on the bulge of the muscles when the rectus femoris bulges outward is obtained to the extent that the elastic band members do not pass over the bulge of the rectus femoris. The front thigh elastic band members 2*bx* connect with the back thigh elastic band members 2*c* shown in FIG. 21B from the vicinity of the greater trochanter in the side parts of the pelvic region. The lower parts of the front thigh elastic band members 2*bx* connect with the lower parts of the back thigh elastic band members 2*c* at the lower inside of each thigh. Furthermore, it is desirable that the width of the front thigh elastic band members 2*bx* be approximately 10 to 15 cm in the portions of maximum width that contact the areas in the vicinity of the side parts of the pelvic region, and that this width be approximately 4 to 5 cm in the portions of minimum width that contact the thighs. It is desirable that the vertical width of the connecting portions between the lower parts of the front thigh elastic band members 2*bx* and the lower parts of the back thigh elastic band members 2*c* on the insides of the thighs be approximately 8 cm. As a result of the formation of such front thigh elastic band members 2*bx*, muscular contractions on the front surfaces of the thighs can be supported. Furthermore, the back thigh elastic band members 2*du* shown in FIG. 21B connect with parts of the back thigh elastic band members 2*c* located near the center of the rear side of each thigh, and are formed only on the upper inside of each thigh.

Furthermore, concrete examples of the respective elastic band members formed in the above-knee length sports spats (FIGS. 17 through 21) may also be applied to ankle length sports spats, below-knee length sports spats or the like.

Furthermore, in sports spats, the elastic band members formed on the pelvic region above the thighs may also be formed as follows. For example, these elastic band members may be formed in locations including the greater trochanter on the outsides of the thighs, and may further contact the side parts of the pelvic region from the greater trochanter, and be formed continuously in a substantially rectilinear shape to the waist. Furthermore, these elastic band members may contact the side parts of the pelvic region and the area above the swell of the hips from the greater trochanter, and may terminate at the waistline. Alternatively, these elastic band members may extend from the area above the swell of the hips toward the rear center, and the left and right elastic band members may be connected in the vicinity of the rear center of the waistline. The elastic band member may extend from the greater trochanter along part of the bulge of the hips and its left and right portions may be connected to each other near the rear center of the waist line. The elastic band member may extend from the greater trochanter along the abdomen and its left and right portions may be connected to each other at the center of the abdomen. The elastic band member may be formed by combining these elastic band members.

The method of adding a elastic band member to the pants garment according to the present invention is not limited to the method described in the above embodiment. For example, a stretchable cloth having a predetermined shape may be overlaid on the main body of a pants garment and be sewn together, thus forming a elastic band member, or a stretchable cloth having a predetermined shape may be overlaid on the main body of a pants garment and be adhered to it, thus forming a elastic band member. If such methods are used, the difference in the tightening force between the main body of the garment and the elastic band members can easily be set in an appropriate manner; furthermore, a large tightening force difference can be achieved. A elastic band member and other portions may be formed as parts having predetermined shapes, and may be connected to each other, thus forming a pants garment according to the present invention. The elastic band member may be formed by the method of stretching a stretchable cloth having a predetermined shape and overlaying it on the main body of a pants garment, and sewing or adhering them together. Furthermore, in cases where a material that is stretchable is overlaid on the pants garment, it is desirable that the tightening force of this stretchable material that forms the elastic band members be stronger than the tightening force of the main body of the pants garment. According to these methods, a strong tightening force can be obtained by the elastic band member. Alternatively, the elastic band member may be formed by the method of impregnating with an elastic resin a predetermined portion of the main body of a pants garment, or adhering an elastic resin film to the predetermined portion of the main body of a pants garment. According to these methods, a garment with a comparatively thin elastic band member can be obtained. As the elastic resin, a polyurethane resin, a polyester elastomer resin, or other elastic resins can be employed. According to these methods, overlaying need not be performed, so a garment with a thinner elastic band member can be obtained. Furthermore, elastic band members may be formed by a knitted fabric with a strong tightening force by varying the knitted fabric of the stretchable material forming the main body of the pants garment by means of jacquard weaving such as warp knitting or circular knitting, so that a difference in the strength of the tightening force is obtained. According to these methods, overlaying need not be performed, so a garment with a thinner elastic band member can be obtained. Furthermore, in cases where a circular knit material or the like is used as the material that forms the pants garment, elastic band members with a relatively strong tightening force can also be formed by cut-boss knitting in which yarn is partially added. In the case of circular knitting, a difference in the strength of the tightening force can also be obtained by combining a method that varies the knitted fabric and a cut-boss knitting method in which yarn is partially added.

Although the embodiment described above exemplifies sports spats as a typical example of a pants garment, the present invention can also be applied to garments other than sports spats. For example, the present invention can also be applied to a pants garment such as girdles, sports tights, spats type swimming wear, sports wear, panty hoses, and tights.

With the garment with the crotch according to the present invention, as the motions of muscles necessary for the bending and stretching motion the inner and outer pivoting motion and the inner and outer rotating motion can be supported by the band like elastic band member, an excellent effect that the motion of the leg can be supported with a good balance can be expected.

What is claimed is:

1. A pants garment, comprising:

left and right leg members for covering the left and right thigh and leg areas of a wearer, each leg member independently comprising a first stretchable portion and a second stretchable portion, wherein said second stretchable portions have a greater tightening force for applying greater pressure than said first stretchable portions, and independently include a front second stretchable portion provided at a front side of each of the leg members, said front second stretchable portion extending obliquely from an upper front portion to a lower front portion of each leg member, and a back second stretchable portion provided at a back side of each of the leg members, said back second stretchable portion extending obliquely from an upper back portion to a lower back portion of each leg member, wherein for each leg member, the front second stretchable portion and a first portion of the back second stretchable portion meet at least at an inner lower portion of the thigh leg member wherein at least either one of the left leg member or the right leg member has the front second stretchable portion extending continuously along the front side from an outer waist portion, along a front outer hip portion, to an inner knee portion of the left or right leg member and then to an outer ankle portion, respectively, and wherein a second portion of the back second stretchable portion extends from an inner upper portion to an outer lower portion of each leg member.

2. A garment as defined in claim 1, wherein at least either one of the left leg member or the right leg member has the front second stretchable portion and the back second stretchable portion inclined in the same direction.

3. A garment as defined in claim 1, wherein at least either one of the left leg member or the right leg member has the front second stretchable portion extending to a position corresponding to the left or right greater trochanter of a wearer, respectively.

4. A garment as defined in claim 1, wherein the front second stretchable portion extends from the lower part of the inside of the corresponding thigh to the corresponding greater trochanter via the upper part of the front surface of the corresponding thigh, and wherein said front second stretchable portion is curved in an indented shape toward the upper part of the corresponding thigh.

5. A garment as defined in claim 1, further comprising:

left and right pelvic members attached to said leg members for covering the right and left pelvic areas of a wearer.

6. A garment as defined in claim 5, further comprising:

an abdomen member attached to said pelvic members for covering the abdominal area of a wearer.

7. A garment as defined in claim 6, further comprising:

a waist member attached to at least one of said thigh leg members, said pelvic members, and said abdomen member, for circumscribing the waist of the wearer.

8. A pants garment, comprising:

left and right leg members for covering the left and right thigh areas of a wearer, each leg member independently comprising a first thigh stretchable portion and a second stretchable portion, wherein said second stretchable portions have a greater tightening force for applying greater pressure than said first stretchable portions, and independently include a front second stretchable portion provided at a front side of each of the leg members, said front second stretchable portion extending continuously along the front side obliquely from a front waist portion, along a front outer hip portion, to a lower front ankle portion of each leg member, a first back second stretchable portion provided at a back side of each of the leg members, said first back second stretchable portion extending obliquely from an upper back portion to a lower back portion of each leg member, and a second back second stretchable portion extending from an upper portion to a lower portion of said leg member, such that the first and second back stretchable portions cross each other.

9. A garment as defined in claim 8, wherein at least either one of the left leg member or the right leg member has the front second stretchable portion and the back second stretchable portion inclined in opposite directions.

10. A garment as defined in claim 8, wherein at least either one of the left leg member or the right leg member has the front second stretchable portion and the back second stretchable portion inclined in the same direction.

11. A garment as defined in claim 8, wherein for each leg member, the front second stretchable portion and the back second stretchable portion meet at least at an inner lower portion of the leg member.

12. A garment as defined in claim 8, wherein at least either one of the left leg member or the right leg member has the front second stretchable portion extending to a position corresponding to the left or right greater trochanter of a wearer, respectively.

13. A garment as defined in claim 8, wherein the front second stretchable portion extends from the lower part of the inside of the corresponding thigh to the corresponding greater trochanter via the upper part of the front surface of the corresponding thigh, and wherein said front second stretchable portion is curved in an indented shape toward the upper part of the corresponding thigh.

14. A garment as defined in claim 8, further comprising:

left and right pelvic members attached to said members for covering the right and left pelvic areas of a wearer.

15. A pants garment, comprising:

left and right leg members for covering the left and right thigh areas of a wearer, each leg member independently comprising a first thigh stretchable portion and a second stretchable portion, wherein said second stretchable portions have a greater tightening force for applying greater pressure than said first stretchable portions, and independently include a front second stretchable portion provided at a front side of each of the leg members, said front second stretchable portion extending obliquely from an upper front portion to a lower front portion of each leg member, and a first back second stretchable portion provided at a back side of each of the leg members, said first back second stretchable portion extending obliquely from an upper back portion to a lower back portion of each leg member, a second back second stretchable portion extending from an upper portion to a lower portion of said leg member, such that the first and second back second stretchable portions cross each other;

wherein for each leg member, the front second stretchable portion and the second back second stretchable portion meet at least at an inner lower portion of the thigh leg member wherein at least either one of the left leg member or the right leg member has the front second stretchable portion extending continuously along the front side from an outer waist portion, along a front outer hip portion, to an inner knee portion of the left or right leg member, respectively, and wherein the first back second stretchable portion extends from an inner upper portion to an outer lower portion of each leg member.

* * * * *